US011643927B2

(12) United States Patent
Henao et al.

(10) Patent No.: US 11,643,927 B2
(45) Date of Patent: May 9, 2023

(54) USING DISTRIBUTED ACOUSTIC SENSING (DAS) CUMULATIVE STRAIN TO RELATE NEAR WELLBORE COMPLETIONS PERFORMANCE AND FAR-FIELD CROSS WELL COMMUNICATION

(71) Applicant: Halliburton Energy Services, Inc., Houston, TX (US)

(72) Inventors: Tito C Henao, Katy, TX (US); Grayson Dane Byrd, Houston, TX (US); Nathaniel Andrew Meyer, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 42 days.

(21) Appl. No.: 17/124,262

(22) Filed: Dec. 16, 2020

(65) Prior Publication Data

US 2022/0186614 A1 Jun. 16, 2022

(51) Int. Cl.

| | |
|---|---|
| ***E21B 49/00*** | (2006.01) |
| ***E21B 43/26*** | (2006.01) |
| ***E21B 47/06*** | (2012.01) |
| ***E21B 47/107*** | (2012.01) |

(52) U.S. Cl.

CPC ..... *E21B 49/00* (2013.01); *E21B 43/26* (2013.01); *E21B 47/06* (2013.01); *E21B 47/107* (2020.05)

(58) Field of Classification Search

CPC ..... E21B 43/26; E21B 47/135; E21B 47/107; E21B 43/267; E21B 49/00; E21B 47/06; E21B 47/11; E21B 47/14

See application file for complete search history.

(56) References Cited

U.S. PATENT DOCUMENTS

2013/0298665 A1 11/2013 Minchau
2020/0309982 A1 10/2020 Jin et al.

FOREIGN PATENT DOCUMENTS

WO WO-2016018280 A1 * 2/2016 ..... E21B 47/06

OTHER PUBLICATIONS

Office Action issued for Canadian Patent Application No. 3,106,797, dated Mar. 24, 2022, 5 pages.

(Continued)

*Primary Examiner* — Zakiya W Bates
(74) *Attorney, Agent, or Firm* — Kilpatrick Townsend & Stockton LLP

(57) ABSTRACT

Distributed acoustic sensing (DAS) measurements may be acquired at an observation wellbore during a current stage of a stimulation treatment along a treatment wellbore within a reservoir formation. A cumulative strain trace for the current stage of the stimulation treatment may be determined based on the DAS measurements. Based on the cumulative strain trace, whether or not to adjust a spacing of perforation clusters and/or a stage length used at the treatment wellbore for a subsequent stage of the stimulation treatment may be determined. Responsive to determining to adjust the spacing of the perforation dusters or to adjust the stage length, at least one treatment parameter for the subsequent stage may be adjusted. The subsequent stage may be performed based on the adjusted at least one treatment parameter.

15 Claims, 11 Drawing Sheets

(56) References Cited

OTHER PUBLICATIONS

P.Richter, T.Parker, C.Woerpel, Y.Wu, R.Rufino and M.Farhadiroushan, Hydraulic fracture monitoring and optimization in unconventional completions using a high-resolution engineered fibre-optic Distributed Acoustic Sensor, Special Topic: Passive Seismic & Unconventionals, Apr. 2019, 6 pages, First Break, vol. 37, Silixa.

Peter Richter, Tom Parker, Craig Woerpel, Wenxia Wu, Rogelio Rufino and Mahmoud Farhadiroushan, High-resolution Distributed Acoustic Sensor Using Engineered Fiber for Hydraulic Fracture Monitoring and Optimization in Unconventional Completions, Geophysical Society of Houston, May 2020, 6 pages, Houston, Texas.

* cited by examiner

USING DISTRIBUTED ACOUSTIC SENSING (DAS) CUMULATIVE STRAIN TO RELATE NEAR WELLBORE COMPLETIONS PERFORMANCE AND FAR-FIELD CROSS WELL COMMUNICATION

TECHNICAL FIELD

The present disclosure relates generally to multistage hydraulic fracturing treatments for stimulating hydrocarbon production from subsurface reservoirs, and particularly, to Distributed Acoustic Sensing (DAS) based techniques for monitoring and controlling different treatment parameters during such stimulation treatments.

BACKGROUND

In the oil and gas industry, a well that is not producing as expected may need stimulation to increase the production of subsurface hydrocarbon deposits, such as oil and natural gas. Hydraulic fracturing is a type of stimulation treatment that has long been used for well stimulation in unconventional reservoirs. A multistage stimulation treatment operation may involve drilling a horizontal wellbore and injecting treatment fluid into a surrounding formation in multiple stages via a series of perforations or formation entry points along a path of a wellbore through the formation. During each stage of the stimulation treatment, different types of fracturing fluids, proppant materials (e.g., sand), additives and/or other materials may be pumped into the formation via the entry points or perforations at high pressures to initiate and propagate fractures within the formation to a desired extent. With advancements in horizontal well drilling and multistage hydraulic fracturing of unconventional reservoirs, there is a greater need for ways to accurately monitor and control the downhole flow and distribution of injected fluids across different perforation clusters and/or stages so as to efficiently deliver treatment fluid into the subsurface formation.

For instance, multistage hydraulic fracturing may be implemented according to a stimulation treatment plan, which may specify treatment parameters, such as perforation cluster spacing, stage length, and the like, for each stage of the treatment. However, in some cases, it may be beneficial to modify the treatment plan based on an analysis of measurements acquired during the operation (e.g., during a stage or between stages of the treatment). For instance, the analysis may reveal whether the operation is meeting performance metrics (e.g., in terms of time, cost, efficiency, etc.) and whether any modification of the stimulation treatment plan is necessary to improve this performance. Moreover, in some cases, the wellbore may lack sensors to collect sufficient measurements for the analysis. Accordingly, data collected from alternative sources (e.g., an observation well) may better inform stimulated treatment plan design decisions.

BRIEF DESCRIPTION OF THE DRAWINGS

The present disclosure is best understood from the following detailed description when read with the accompanying figures.

DETAILED DESCRIPTION

Figure 1:
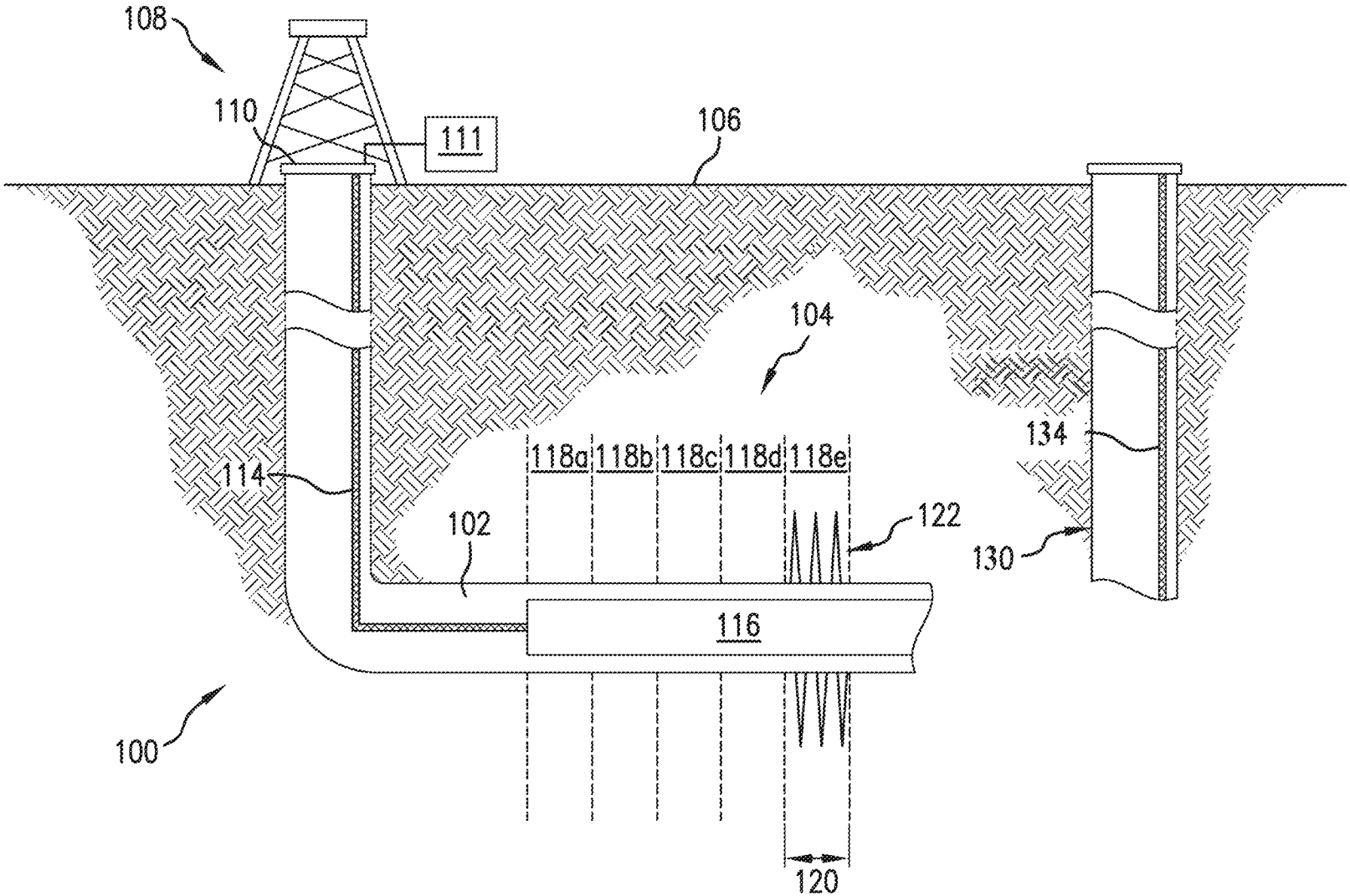
FIG. 1 is a diagram of an illustrative wellbore system for performing a multistage stimulation treatment within a subsurface hydrocarbon-bearing formation.

Embodiments of the present disclosure relate to real-time monitoring and control of treatment parameters, such as perforation cluster spacing and stage length, for downhole stimulation treatments. While the present disclosure is described herein with reference to illustrative embodiments for particular applications, it should be understood that embodiments are not limited thereto. Other embodiments are possible, and modifications can be made to the embodiments within the spirit and scope of the teachings herein and additional fields in which the embodiments would be of significant utility.

It would also be apparent to one of skill in the relevant art that the embodiments, as described herein, can be implemented in many different embodiments of software, hardware, firmware, and/or the entities illustrated in the figures. Any actual software code with the specialized control of hardware to implement embodiments is not limiting of the detailed description. Thus, the operational behavior of embodiments will be described with the understanding that modifications and variations of the embodiments are possible, given the level of detail presented herein.

In the detailed description herein, references to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to implement such feature, structure, or characteristic in connection with other embodiments whether or not explicitly described.

As will be described in further detail below, embodiments of the present disclosure may be used to make operational decisions regarding the spacing of perforation clusters and/or stage lengths during a stimulation treatment. The stimulation treatment may involve injecting treatment fluid into a subsurface formation via one or more perforation clusters (e.g., injection points) along a length of a stage of a wellbore along portion of the wellbore) within the subsurface formation. In some embodiments, real-time measurements, such as distributed acoustic sensing (DAS) measurements, may be used to monitor cumulative strain fields within the formation over it) the course of stages of the stimulation treatment. For instance, the DAS measurements collected during a current stage of the stimulation treatment may be used to calculate a cumulative strain within the formation over the course of the current stage. In one or more embodiments, the cumulative strain may be calculated relative to the depth or length of the current stage as a cumulative strain trace. As will be described in further detail below, the cumulative strain trace may provide information associated with the performance and/or efficiency of the current stage of the stimulation treatment. This information may then be used to adjust one or more treatment parameters of the stimulation treatment so that the performance and/or efficiency of a subsequent stage of the stimulation treatment is improved.

In one or more embodiments, a performance metric in the form of perforation cluster spacing efficiency may be determined for a current stage of the stimulation treatment based on the cumulative strain trace and the number of clusters included in the current stage. In particular, the number of local maxima included in the cumulative strain trace may be representative of flow allocation (e.g., distribution) of the treatment fluid through the perforation clusters (or "cluster flow"). For example, flow of the treatment fluid through one or more of the perforation clusters may result from a distribution of the treatment fluid to one or more perforation clusters and may correspond to a particular local maximum within the cumulative strain trace. Thus, by determining a perforation cluster ratio between the number of identified local maxima and the number of perforation clusters used in the current stage, the interaction of different streams of the stimulation treatment fluid flowing through separate perforation clusters may be estimated and/or determined. For instance, the stimulation fluid that is injected into the formation may flow through the different perforation clusters in separated streams (e.g., along different flow paths) that do not merge or combine before measurement via DAS. In this case, the number of local maxima identified within the cumulative strain trace that is calculated based on the DAS measurements may be approximately equal to the number of perforation clusters used in the current stage. Accordingly, the calculated perforation cluster ratio for this stage may be approximately equal to 1. On the other hand, if, after flowing through the different perforation clusters, the separated flow paths of the stimulation fluid unite or merge together, the number of local maxima identified within the cumulative strain trace may be less than the number of perforation clusters used in the current stage, resulting in a relatively smaller perforation cluster ratio value. In some embodiments, the perforation cluster ratio calculated for a current stage may be compared against a minimum perforation cluster ratio value (e.g., a predetermined minimum threshold value) to determine whether to make any appropriate adjustments to treatment parameters for a subsequent stage. For example, if the perforation cluster ratio calculated for the current stage is less than the minimum value, the spacing of perforation clusters in a subsequent stage of the stimulation treatment may be adjusted, e.g., by increasing the spacing of perforation clusters in the subsequent stage relative to the current stage so that streams of stimulation fluid flowing through the subsequent stage remain more uniform. In this way, the performance of the stimulation treatment may be continuously improved over each stage of the stimulation treatment.

In some embodiments, stage length of the stages included in the stimulation treatment may be optimized based on cumulative strain traces corresponding to the stimulation treatment. In particular, inter-stage stimulated reservoir volume overlapping and inter-stage reservoir volume by-passing may be reduced, which may minimize redundant, repeated use of stimulation fluid within a particular area of the subsurface formation and may minimize the number of untreated areas within the subsurface formation, respectively. For instance, by comparing the cumulative strain trace of a current stage with the cumulative strain trace of one or more previous stages in the stimulation treatment, overlap or a gap between the current stage and the one or more previous stages may be identified and the stage length of a subsequent stage may be adjusted accordingly. In response to identifying an overlap between the current stage and a previous stage, for example, the stage length of a subsequent stage may be increased. Conversely, in response to identifying a gap between the current stage and a previous stage, the stage length of the subsequent stage may be decreased.

Illustrative embodiments and related methodologies of the present disclosure are described below in reference to the examples shown in FIGS. 1-10 as they might be employed in, for example, a computer system for real-time monitoring and control of treatment parameters (e.g., perforation cluster spacing, stage length, and/or the like) during stimulation treatments. Various features and advantages of the disclosed embodiments will be or will become apparent to one of ordinary skill in the art upon examination of the following figures and detailed description. It is intended that all such additional features and advantages be included within the scope of the disclosed embodiments. Further, the illustrated figures are only exemplary and are not intended to assert or imply any limitation with regard to the environment, architecture, design, or process in which different embodiments may be implemented. While examples may be described in the context of a multistage hydraulic fracturing treatment, it should be appreciated that the described techniques are not intended to be limited thereto and that these techniques may be applied to other types of stimulation treatments, e.g., matrix acidizing treatments.

FIG. 1 is a diagram illustrating an example of a wellbore system 100 for performing a stimulation treatment within a hydrocarbon reservoir formation. As shown in the example of FIG. 1, wellbore system 100 includes a wellbore 102

(e.g., a treatment wellbore) in a subsurface formation 104 (e.g., a reservoir formation) beneath a surface 106 of the wellsite. Although wellbore 102 is shown in the example of FIG. 1 as a horizontal wellbore, it should be appreciated that embodiments of the present disclosure are not limited thereto and that the disclosed diversion control techniques may be applied to wellbores in any orientation including, but not limited to, horizontal, vertical, slant, curved, and/or a combination thereof. The subsurface formation 104 in this example may include a reservoir of hydrocarbon deposits, such as oil, natural gas, and/or others. For example, the subsurface formation 104 may be a rock formation (e.g., shale, coal, sandstone, granite, and/or others) that includes oil and natural gas deposits trapped within one or more layers of the formation. In some cases, the subsurface formation 104 may be a tight gas formation that includes low permeability rock (e.g., shale, coal, and/or others). The subsurface formation 104 may be composed of naturally fractured rock and/or rock formations that are not fractured to any significant degree.

In one or more embodiments, wellbore system 100 may also include a fluid injection system 108 for injecting treatment fluid, e.g., hydraulic fracturing fluid, into the subsurface formation 104 over multiple sections 118*a*, 118*b*, 118*c*, 118*d*, and 118*e* (collectively referred to herein as "sections 118") of the wellbore 102, as will be described in further detail below. Each of the sections 118 may correspond to, for example, a different stage or interval of the multistage stimulation treatment that is performed along a portion of the wellbore 102. The boundaries of the respective sections 118 and corresponding treatment stages/intervals along the length of the wellbore 102 may be delineated by, for example, the locations of bridge plugs, packers and/or other types of equipment in the wellbore 102. Additionally or alternatively, the sections 118 and corresponding treatment stages may be delineated by particular features of the subsurface formation 104. Each of the sections 118 may have different stage lengths 120 (e.g., horizontal widths/distances or vertical depth ranges) or may be uniformly distributed along the wellbore 102. Moreover, as described in greater detail below, the stage lengths 120 may be adjusted to minimize inter-stage stimulated reservoir volume overlapping and reservoir volume by-passing, based on measurements (e.g., DAS measurements) collected during the stimulation treatment. Although five sections 118 are shown in FIG. 1, it should be appreciated that any number of sections and/or treatment stages may be used as desired for a particular implementation.

As shown in FIG. 1, injection system 108 in this example includes an injection control subsystem 111 at the surface 106 along with a signaling subsystem 114 and one or more injection tools 116 within the wellbore 102. The injection control subsystem 111 may communicate with the injection tools 116 from a surface 110 of the wellbore 102 via the signaling subsystem 114. Although not shown in FIG. 1, injection system 108 may include additional and/or different features for implementing the perforation cluster spacing and stage length control techniques disclosed herein. For example, the injection system 108 may include any number of computing subsystems, communication subsystems, pumping subsystems, monitoring subsystems, and/or other features as desired for a particular implementation. In some implementations, the injection control subsystem 111 may be communicatively coupled to a remote computing system (not shown) for exchanging information via a wired or wireless network for purposes of monitoring and control ling wellsite operations, including operations related to the stimulation treatment. Such a network may be, for example and without limitation, a local area network, medium area network, and/or a wide area network, e.g., the Internet.

During each stage of the stimulation treatment, the injection system 108 may alter stresses and create a multitude of fractures in the subsurface formation 104 by injecting treatment fluid (e.g., hydraulic fracturing fluid) into the surrounding subsurface formation 104 via one or more perforation clusters 122 (e.g., injection points) along a portion of the wellbore 102 (e.g., along one or more of sections 118). The fluid may be injected through any combination of one or more valves of the injection tools 116. The injection tools 116 may include numerous components including, but not limited to, valves, sliding sleeves, actuators, ports, and/or other features that communicate treatment fluid from a working string disposed within the wellbore 102 into the subsurface formation 104 via the injection points. The perforation clusters 122 along the wellbore 102 may be, for example, open-hole sections along an uncased portion of the wellbore path, a cluster of perforations along a cased portion of the wellbore path, ports of a sliding sleeve completion device along the wellbore path, slots of a perforated liner along the wellbore path, or any combination of the foregoing. Moreover, as described in greater detail below, the number of perforation clusters 122 used within a stage of the stimulation treatment (e.g., along a section 118 of wellbore 102) may be adjusted based on downhole fiber-optic sensor measurements (e.g., DAS measurements) to achieve a certain flow profile of the treatment fluid through the subsurface formation 104.

In some implementations, the valves, ports, aid/or other features of the injection tools 116 can be configured to control the location, rate, orientation, and/or other properties of fluid flow between the wellbore 102 and the subsurface formation 104. The injection tools 116 may include multiple tools coupled by sections of tubing, pipe, or another type of conduit. The injection tools may be isolated in the wellbore 102 by packers or other devices installed in the wellbore 102.

In one or more embodiments, the injection system 108 may be used to create or modify a complex fracture network in the subsurface formation 104 by injecting fluid into portions of the subsurface formation 104 where stress has been altered. For example, the complex fracture network may be created or modified after an initial injection treatment has altered stress by fracturing the subsurface formation 104 at multiple locations along the wellbore 102. After the initial injection treatment alters stresses in the subterranean formation, one or more valves of the injection tools 116 may be selectively opened or otherwise reconfigured to stimulate or re-stimulate specific areas of the subsurface formation 104 along one or more sections 118 of the wellbore 102, taking advantage of the altered stress state to create complex fracture networks. In some cases, the injection system 108 may be used to inject treatment fluid simultaneously for multiple intervals and sections 118 of wellbore 102.

The operation of the injection tools 116 may be controlled by the injection control subsystem 111. The injection control subsystem 111 may include, for example, data processing equipment, communication equipment, and/or other systems that control injection treatments applied to the subsurface formation 104 through the wellbore 102. In one or more embodiments, the injection control subsystem 111 may receive, generate, or modify a baseline treatment plan for implementing the various stages of the stimulation treatment along the path of the wellbore 102. The baseline treatment plan may specify initial parameters for the treatment fluid to be injected into the subsurface formation 104. The treatment plan may also specify a baseline pumping schedule for the treatment fluid injections, stage lengths 120, and a number of perforation clusters 122 for each stage of the stimulation treatment.

In one or more embodiments, the injection control subsystem 111 initiates control signals to configure the injection tools 116 and/or other equipment (e.g., pump trucks, etc.) for operation based on the treatment plan. The signaling subsystem 114 as shown in FIG. 1 transmits the signals from the injection control subsystem 111 at the wellbore surface 110 to one or more of the injection tools 116 disposed in the wellbore 102. For example, the signaling subsystem 114 may transmit hydraulic control signals, electrical control signals, and/or other types of control signals. The control signals may be reformatted, reconfigured, stored, converted, retransmitted, and/or otherwise modified as needed or desired en route between the injection control subsystem 111 (and/or another source) and the injection tools 116 (and/or another destination). The signals transmitted to the injection tools 116 may control the configuration and/or operation of the injection tools 116. Examples of different ways to control the operation of each of the injection tools 116 include, but are not limited to, opening, closing, restricting, dilating, repositioning, reorienting, and/or otherwise manipulating one or more valves of the tool to modify the manner in which treatment fluid, proppant, or diverter is communicated into the subsurface formation 104.

It should be appreciated that the combination of injection valves of the injection tools 116 may be configured or reconfigured at any given time during the stimulation treatment, for example, via control signals transmitted by the injection control subsystem 111 in response to user input or automatically over the course of the treatment without any user intervention. It should also be appreciated that the injection valves may be used to inject any of various treatment fluids, proppants, and/or diverter materials into the subsurface formation 104. Examples of such proppants include, but are not limited to, sand, bauxite, ceramic materials, glass materials, polymer materials, polytetrafluoroethylene materials, nut shell pieces, cured resinous particulates comprising nut shell pieces, seed shell pieces, cured resinous particulates comprising seed shell pieces, fruit pit pieces, cured resinous particulates comprising fruit pit pieces, wood, composite particulates, lightweight particulates, microsphere plastic beads, ceramic microspheres, glass microspheres, manmade fibers, cement, fly ash, carbon black powder, and combinations thereof.

In some implementations, the signaling subsystem 114 transmits a control signal to multiple injection tools, and the control signal is formatted to change the state of only one or a subset of the multiple injection tools. For example, a shared electrical or hydraulic control line may transmit a control signal to multiple injection valves, and the control signal may be formatted to selectively change the state of only one (or a subset) of the injection valves. In some cases, the pressure, amplitude, frequency, duration, and/or other properties of the control signal determine which injection tool is modified by the control signal. In some cases, the pressure, amplitude, frequency, duration, and/or other properties of the control signal determine the state of the injection tool affected by the modification.

In one or more embodiments, the injection tools 116 may include various sensors for collecting data relating to downhole operating conditions and formation characteristics along the wellbore 102. Such sensors may serve as real-time data sources at the well site for various types of downhole measurements and diagnostic information pertaining to each stage of the stimulation treatment. Examples of such sensors include, but are not limited to, micro-seismic sensors, tiltmeters, pressure sensors, and other types of downhole sensing equipment. The data collected downhole by such sensors may include, for example, real-time measurements and diagnostic data for monitoring the extent of fracture growth and complexity within the surrounding formation along the wellbore 102 during each stage of the stimulation treatment, e.g., corresponding to one or more sections 118.

In one or more embodiments, the injection tools 116 may include fiber-optic sensors for collecting real-time fiber-optic measurements during the stimulation treatment. For example, the fiber-optic sensors may be components of DAS, distributed temperature sensing (DTS), and/or distributed strain sensing (DSS) subsystems of the injection system 108. However, it should be appreciated that embodiments are not intended to be limited thereto and that the injection tools 116 may also include any of various measurement and diagnostic tools. In some implementations, the injection tools 116 may be used to inject particle tracers, e.g., tracer slugs, into the wellbore 102 for monitoring the flow distribution based on the distribution of the injected particle tracers during the treatment. For example, such tracers may have a unique temperature profile that the DTS subsystem of the injection system 108 can be used to monitor over the course of a treatment stage. Additionally or alternatively, in some embodiments, measurement tools, such as fiber-optic sensors, may be included in an observation wellbore 130 of the wellbore system 100 in communication with the injection control subsystem 111. In some instances, for example, the injection tools 116 may lack fiber-optic sensors (e.g., the injection system 108 may be fiberless) and measurement data may instead be collected from another well (e.g., the observation wellbore 130). In other instances, data collected by sensors within the injection system 110 and/or the injection tools 116 may be supplemented and/or verified by measurements collected from another well (e.g., the observation wellbore 130). In any case, sensors, such as fiber-optic sensors 134, within the observation wellbore 130 (e.g., a far-field well) may collect data associated with the wellbore 102 of the injection system 108 during stimulation treatment of the wellbore 102. The fiber-optic sensors 134 within the observation wellbore 130 may be components of DAS, distributed temperature sensing (DTS), and/or distributed strain sensing (DSS). Further, the observation wellbore 130 may be positioned within the same reservoir formation as the wellbore 102 (e.g., the subsurface formation 104) or a different reservoir formation.

In one or more embodiments, the signaling subsystem 114 may be used to transmit real-time measurements and diagnostic data collected downhole by one or more of the aforementioned data sources to the injection control subsystem 111 for processing at the wellbore surface 110. Thus, in the fiber-optics example above, the real-time measurements collected by the fiber-optic sensors may be transmitted to the injection control subsystem 111 via fiber-optic cables included within the signaling subsystem 114. The injection control subsystem 111 (or data processing components thereof) may use the real-time measurements received from such fiber-optic data sources to monitor fracture growth and stress within the formation as the stimulation treatment is performed along the wellbore 102. Additionally or alternatively, real-time measurements may be received at the injection control subsystem 111 via the observation wellbore 130 and/or the fiber-optic sensors 134, as described above. For instance, the fiber-optic sensors 134 may be a component of or in communication with a signaling subsystem substantially similar to the signaling subsystem 114. In one or more embodiments, the real-time data may be used to adjust the spacing of perforation clusters 122 and/or stage lengths 120 over stages of a multistage stimulation treatment to improve performance of the injection system 108, as will be described in further detail below. For instance, the injection control subsystem 111 may, automatically and/or in response to a user input, transmit control signals to one or more downhole tools (e.g., injection tools 116) to adjust the spacing of perforation clusters 122 and/or stage lengths 120 over stages of a multistage stimulation treatment to improve performance of the injection system 108.

Figure 2:
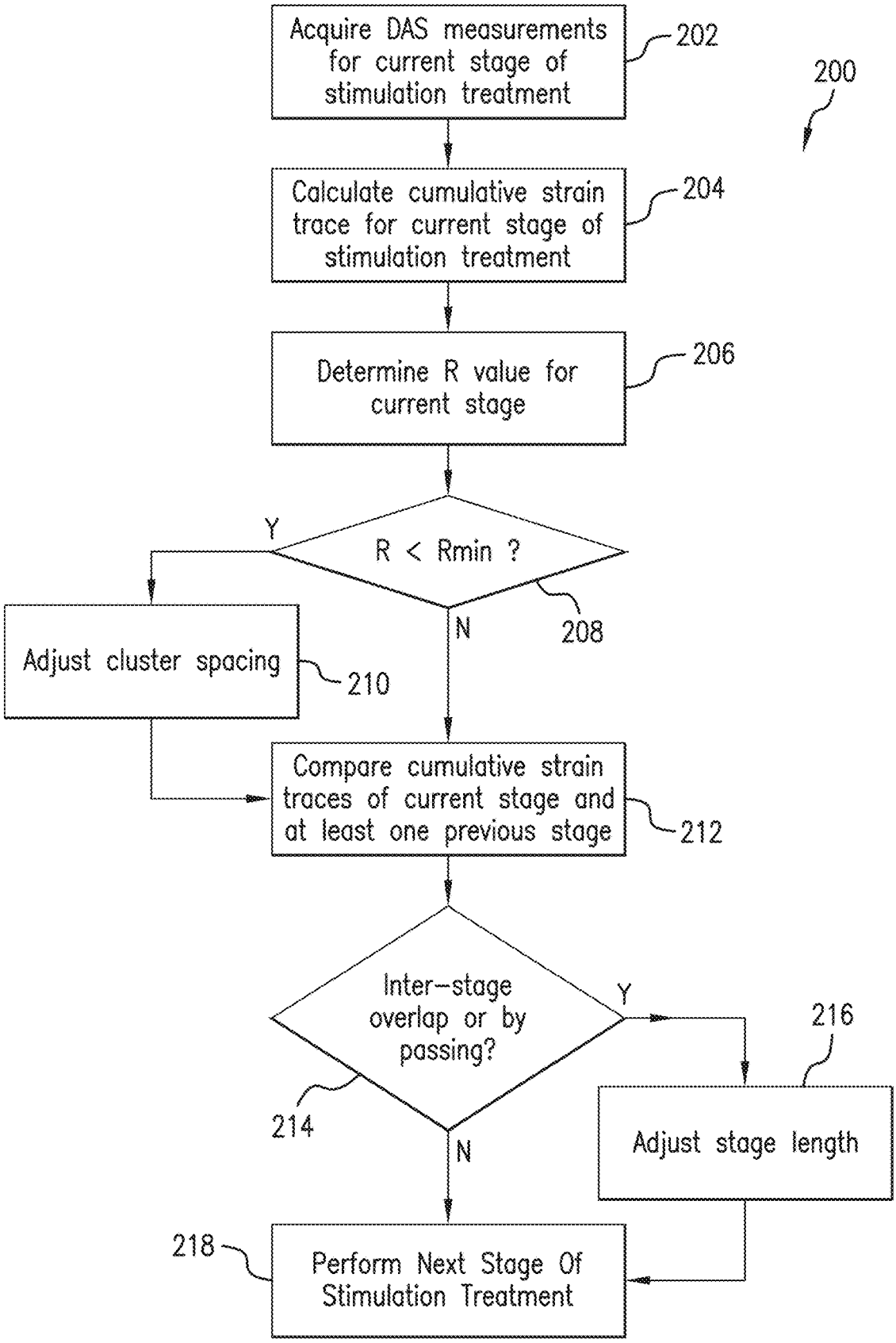
FIG. 2 is a flow diagram of an illustrative process for monitoring and controlling perforation cluster spacing and stage length based on distributed acoustic sensing (DAS) measurements acquired over different stages of a stimulation treatment.

FIG. 2 is a flow diagram of an illustrative process 200 for adjusting one or more treatment parameters (e.g., perforation cluster spacing and/or stage lengths) during a multistage stimulation treatment based on real-time fiber-optic measurements (e.g., DAS measurements). For discussion purposes, process 200 will be described using the wellbore system 100 of FIG. 1. However, process 200 is not intended to be limited thereto. It is assumed for purposes of this example that the stimulation treatment is a multistage stimulation treatment, e.g., a multistage hydraulic fracturing treatment, in which each stage of the treatment is conducted along a portion of a wellbore drilled within a subsurface formation. For example, each stage of the treatment may correspond to at least one of the sections 118 along the wellbore 102 of FIG. 1, as described above.

In block 202, DAS measurements are acquired for a current stage of the stimulation treatment along the wellbore 102 (e.g., a treatment wellbore) within the subsurface formation 104. The DAS measurements may be obtained by DAS sensors (e.g., distributed fiber-optic sensors) within the observation wellbore 130 (e.g., a far-field well), which is spaced at some distance away from and in communication with the wellbore 102. Accordingly, acquiring the DAS measurements in block 202 may involve receiving the DAS measurements from the observation wellbore 130. For instance, a computer system associated with the observation wellbore 130 may communicate the DAS measurements to a computer or data processing system, such as the injection control subsystem 111, associated with the wellbore 102 via a wireless or wired connection. Additionally or alternatively, the measurements may be collected at the wellbore 102 itself during the current stage of the stimulation treatment. For instance, the injection tools 116 disposed within the wellbore 102 may include DAS sensors, which may obtain the DAS measurements from within the wellbore 102 during the stimulation treatment. In some implementations, the DAS measurements may be acquired in real time measurements during the stimulation treatment (e.g., during an injection phase of the treatment as treatment fluid is injected or pumped into the wellbore 102 and surrounding formation).

In block 204, a cumulative strain trace may be calculated for the current stage of the stimulation treatment based on the DAS measurements obtained in block 202. The cumulative strain trace may be calculated either directly from the DAS measurements or from a differential strain determined using the DAS measurements, as will be described in further detail below with reference to FIGS. 3 and 4.

Figure 3:
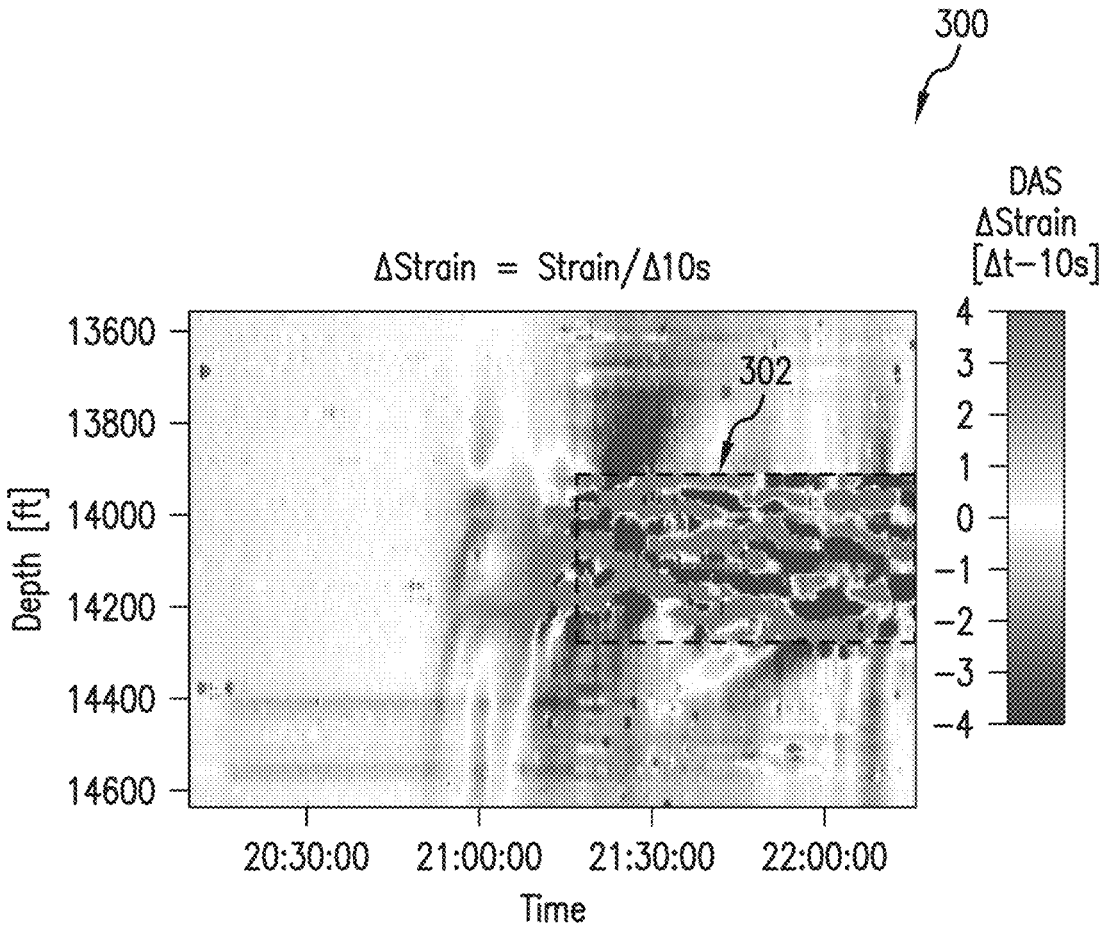
FIG. 3 is a plot of differential strain within a subsurface formation during a stage of a stimulation treatment based on DAS measurements.

FIG. 3 illustrates a plot 300 of a scalar field of differential strain resulting from fluid injection within a subsurface formation (e.g., subsurface formation 104 of FIG. 1, as described above) during a stage of a stimulation treatment. The plot 300 may be derived from acoustic activity data obtained by one or more downhole sensors, such as a DAS sensor, located within the at the observation wellbore 130. The relationship between strain, denoted as ε, in the rock formation and the measured activity (e.g., acoustic data) collected by the DAS sensor may be determined using Equation (1) as shown below:

$$\varepsilon = \frac{\lambda d\phi}{4\pi n G \xi} \tag{1}$$

where λ represents the operational optical (e.g., vacuum) wavelength of the DAS sensor, dϕ represents the noise floor of the DAS sensor in radians, n represents the refractive index of the sensing fiber (e.g., the group index), G represents the gauge length employed by the DAS sensor, and ξ represents the photo-elastic scaling factor for longitudinal strain in isotropic material.

In FIG. 3, the plot 300 illustrates the differential strain within different depths of the subsurface formation 104 over time. In particular, the plot 300 illustrates the differential strain resulting from a stimulation treatment and detected at the observation wellbore 130. That is, for example, the plot 300 illustrates a strain response at the observation wellbore 130 associated with stimulation fluid that has exited the perforation clusters (or "cluster flow") of the wellbore 102, which may occur during a current stage of the stimulation treatment. The boundaries of the strain event are indicated by the region 302 with respect to depth and time. As further illustrated, the plotted differential strain values are determined with respect to 10 second intervals. For example, acoustic activity values collected at the DAS sensor, which may collect thousands of samples per second, may be binned into 10 second intervals for the determination of the differential strain values. In this way, the plotted differential strain may correspond to strain, as determined using Equation (1), per a 10 second interval (e.g., ε/Δ10 s). However, it should be appreciated that embodiments are not limited thereto and that any interval or period of time may be used for collecting and/or binning the strain values.

Figure 4:
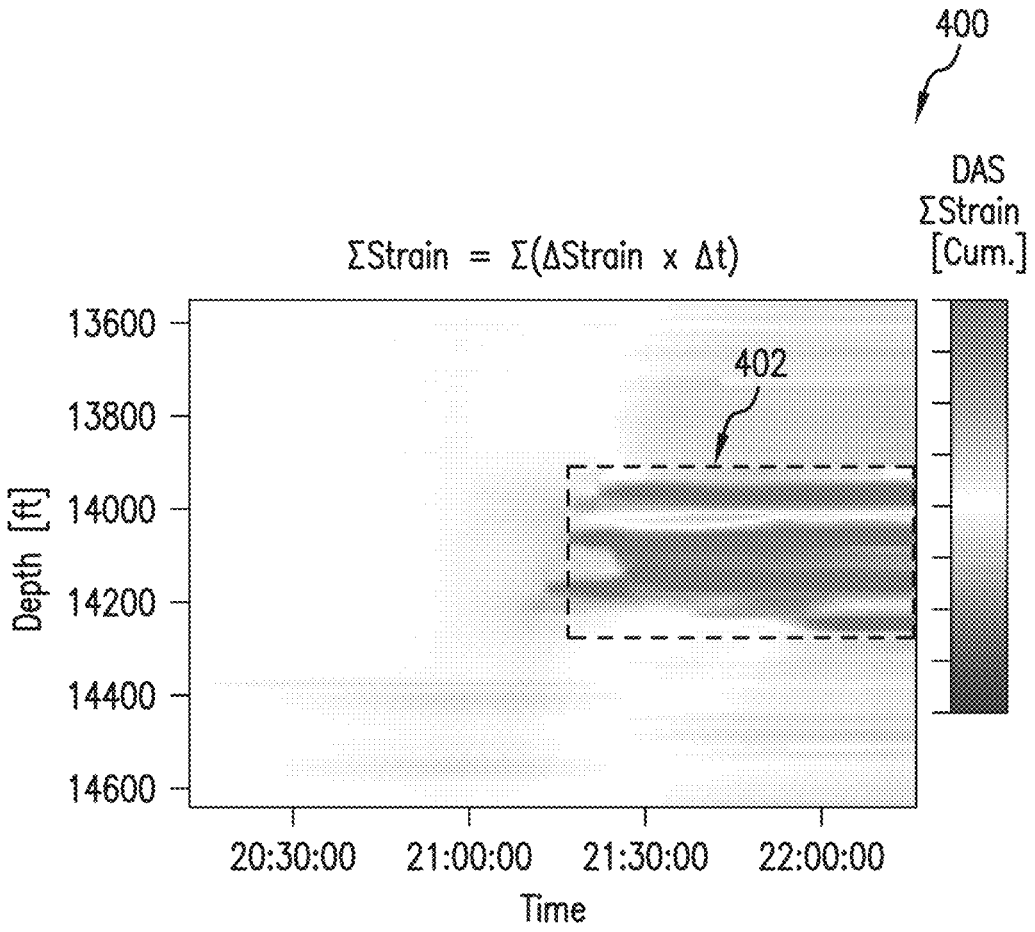
FIG. 4 is a plot of cumulative strain within a subsurface formation during a stage of a stimulation treatment based on DAS measurements.

FIG. 4 illustrates a plot 400 of a scalar field of cumulative strain within the subsurface formation 104 during the stage of the far-field stimulation treatment discussed above. As illustrated, the cumulative strain in plot 400 is determined at different depths of the subsurface formation 104 over the duration of this treatment stage. The boundaries of the stage are indicated by the region 402 with respect to depth (e.g., stage length) and time. In some embodiments, the cumulative strain may be derived from the differential strain within the subsurface formation, for example, by summing (e.g., integrating) the differential strain over time. In such cases, calculating the cumulative strain and/or a cumulative strain trace may involve first determining the differential strain within the subsurface formation. Additionally or alternatively, the cumulative strain may be calculated directly from the DAS measurements. For instance, the cumulative strain may be calculated based on the DAS measurements and Equation 1.

Figure 5:
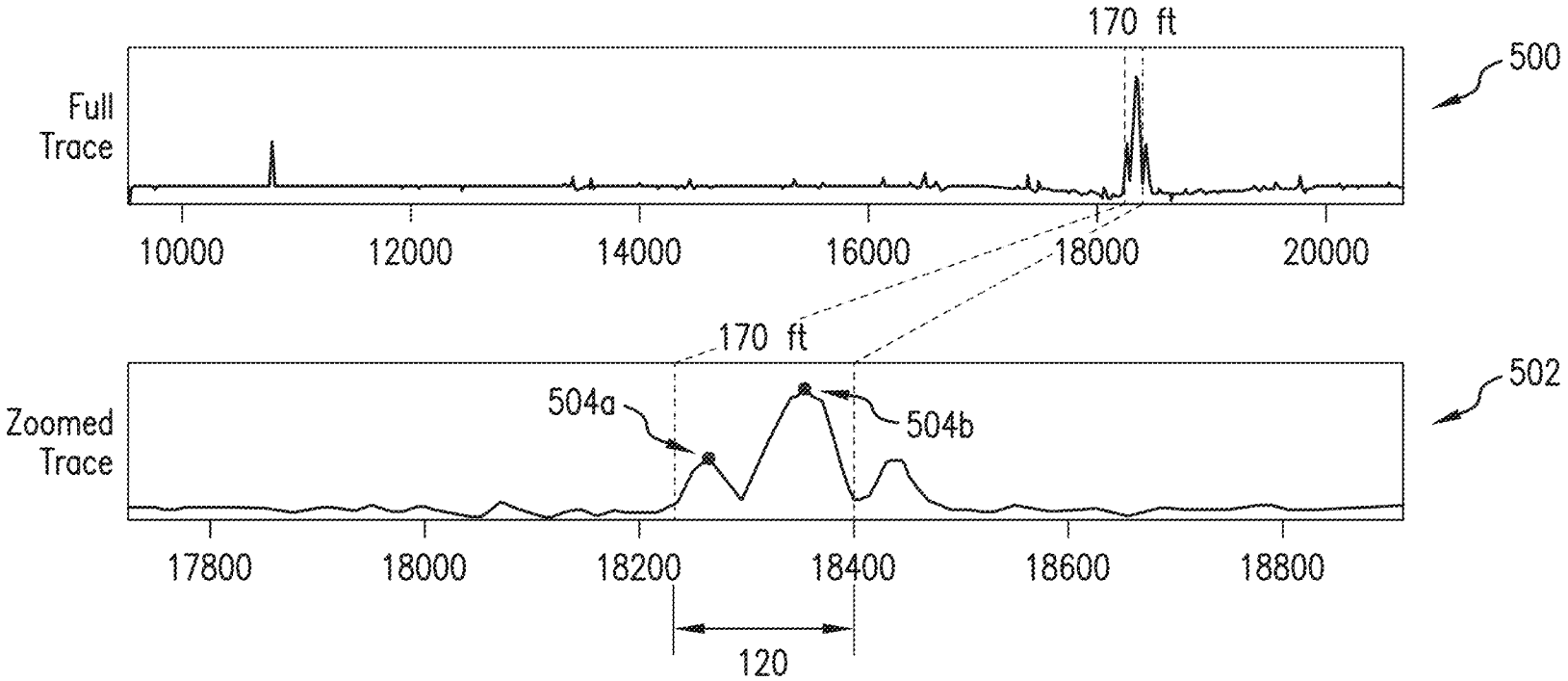
FIG. 5 is a cumulative strain trace plotting the cumulative strain within a subsurface formation during a stage of a stimulation treatment based on DAS measurements.

FIG. 5 illustrates an example of a cumulative strain trace 500. As illustrated, the cumulative strain trace 500 plots the cumulative strain calculated for a stage of a stimulation treatment within a subsurface formation (e.g., subsurface formation 104 of FIG. 1, as described above) based on DAS measurements acquired during the stage (e.g., at the observation wellbore 130). FIG. 5 further illustrates a zoomed view 502 of a portion of the cumulative strain trace 500. In particular, the zoomed view 502 illustrates the cumulative strain within the formation 104 over a stage length 120 (e.g., 170 feet) corresponding to one of the stages of the stimulation treatment. As will be described in greater detail below, the plotted cumulative strain values may be representative of a flow of treatment fluid injected into the subsurface formation 104 from perforation clusters (e.g., perforation clusters 122 along a section 118 of the wellbore 102 shown in FIG. 1, as described above) during the stage of the stimulation treatment. In the case of a vertical wellbore, strain resulting from flow of treatment fluid exiting a first perforation cluster may be detected at a first depth, while strain resulting from flow of treatment fluid exiting a second perforation cluster positioned below the first perforation cluster within the wellbore may be detected at a greater, second depth. Moreover, in cases where the cumulative strain is determined based on DAS measurements obtained from the observation wellbore 130 (e.g., a far-field well), the cumulative strain trace 500 may indicate cross well communication between the wellbore 102 and the observation wellbore 130.

Returning now to FIG. 2, in block 206, a perforation cluster ratio (R) for the current stage may be determined. The perforation cluster ratio may be determined based on the number of local maxima within the cumulative strain trace for the current stage, as well as the number of perforation clusters utilized to perform the current stage. For instance, the perforation cluster ratio, denoted as R, may be determined using Equation (2) as shown below:

$$R = \frac{\text{\# of Strain Peaks}}{\text{\# of Perforation Clusters}} \tag{2}$$

where the numerator (# of strain peaks) corresponds to the number of local maxima (e.g., peak values of cumulative strain) identified within the cumulative strain trace for the current stage, and the denominator (# of perforation clusters) corresponds to the number of perforation clusters used in the current stage to deliver treatment fluid to the subsurface formation. Thus, the perforation cluster ratio may be determined based on the cumulative strain trace for the current stage calculated in block 204. Moreover, the number of perforation clusters used in the current stage may be determined based on a baseline treatment plan that specifies treatment parameters, such as a number of perforation clusters, for stages of the stimulation treatment. Additionally or alternatively, the number of perforation clusters may correspond to an adjusted number of perforation clusters, e.g., after an initial number of perforation clusters indicated in the baseline treatment plan has been modified (e.g., increased or decreased) based on a prior stage of the treatment.

With reference now to FIG. 5, the illustrated cumulative strain trace 500 includes two local maxima corresponding to points 504*a* and 504*b*, as shown in the detailed view 502. The cumulative strain values and resulting number of local maxima included in a cumulative strain trace, such as cumulative strain trace 500, may be representative of the flow (e.g., flow distribution) of treatment fluid that has exited the perforation clusters (or "cluster flow") within a current stage of the stimulation treatment along the wellbore 102 and that has caused a strain response at the observation wellbore 130. For instance, the cumulative strain trace 500 may provide a representation of the flow profile of the treatment fluid pumped through the perforation clusters. For instance, if the treatment fluid flows through the different perforation clusters 122 in separated streams (e.g., separate flow paths) that do not merge or combine before measurement via DAS sensors at an offset or far-field observation wellbore (e.g., observation wellbore 130), each stream may independently cause strain at a corresponding depth within the subsurface formation 104. As such, the number of local maxima identified within the cumulative strain trace may approximately equal the number of perforation clusters 122 used in the current stage, and the calculated ratio may be approximately equal to 1. On the other hand, if, after flowing through the different perforation clusters 122, the separated flow paths of the treatment fluid unite or merge together, strain within the subsurface formation 104 may result from the combination of flows output by multiple perforation clusters 122. As a result, the number of local maxima identified within the cumulative far-field strain trace may be less than the number of perforation clusters 122 used in the current stage, resulting in a smaller ratio R value. Thus, by determining the perforation cluster ratio (R), the interaction of treatment fluid flowing through separate perforation clusters may be estimated and/or determined based on data collected at the observation wellbore 130.

In the example of FIG. 5, the flow of the treatment fluid through one or more of the perforation clusters 122 associated with the current stage of the stimulation treatment may result in strain within the subsurface formation 104 at a depth corresponding to the one or more perforation clusters 122. As such, the flow through the one or more perforation clusters 122 may correspond to a particular local maximum, such as point 504*a* or 504*b*, within the cumulative strain trace 500 measured by DAS sensors in an offset observation well (e.g., observation wellbore 130).

Turning back to FIG. 2, in block 208, the calculated perforation cluster ratio for the current stage may be compared to a minimum (e.g., a threshold) perforation cluster ratio value (Rmin). The perforation cluster ratio is associated with the flow of fluid (e.g., the fluid flow profile) from the perforation clusters 122 within the current stage and, as a result, the spacing; of the perforation clusters 122 within the current stage. Accordingly, comparing the calculated perforation duster ratio to the minimum perforation cluster ratio value (Rmin) may correspond to determining whether the spacing of the perforation clusters 122 within the current stage should be maintained or adjusted in a subsequent stage of the stimulation treatment. To that end, a calculated perforation cluster ratio that is less than the minimum perforation cluster ratio value may correspond to a perforation cluster spacing that is too close (e.g., cramped). That is, a calculated perforation cluster ratio that is less than the minimum perforation cluster ratio value may correspond to a perforation cluster spacing that results in treatment fluid flowing from separate perforation clusters 122 to merge to a greater extent than desirable, as described above.

In some embodiments, the minimum perforation cluster ratio value may be predefined and/or predetermined. For instance, the minimum perforation cluster ratio value may be stored and/or retrieved by a processing system, such as the injection control subsystem 111. In some embodiments, the minimum perforation cluster ratio value may be determined based on one or more characteristics of the subsurface formation 104, the treatment wellbore (e.g., wellbore 102 within formation 104), the fluid injection system 108, the observation wellbore 130, a subsurface formation where the observation wellbore 130 is positioned (if different from formation 104), and/or the like. For instance, different minimum perforation cluster ratio values may correspond to a combination of one or more different rock formations, such as shale, coal, sandstone, granite, and/or the like, different subsurface formation permeabilities, different treatment fluids, different wellbore depths, different distances between the wellbore 102 and the DAS sensor (e.g., within the observation wellbore 130) and/or the like. Moreover, the appropriate minimum perforation cluster ratio values may be determined based on a mapping from the one or more characteristics, which may be stored locally (e.g., at the injection control subsystem 111) and/or accessed remotely (e.g., at a server).

Additionally or alternatively, the minimum perforation cluster ratio value may be determined based on one or more previous stages of the stimulation treatment. For example, in some cases, the perforation cluster ratio value calculated for the first one or more stages of the stimulation treatment may be used to determine the minimum perforation cluster ratio value for the remaining stages of the stimulation treatment. An average, mode, median, and/or other suitable derivation may be used to determine the minimum perforation cluster ratio value from the one or more calculated perforation cluster ratios. Further, in such cases, the minimum perforation cluster may be initialized with a predetermined value for the first one or more stages of the stimulation treatment used to determine the perforation cluster ratio value, and/or the comparison with the minimum perforation cluster ratio value (e.g., block 208) may be omitted for the first one or more stages. In some embodiments, the minimum perforation cluster ratio value may be continuously updated. For instance, for each stage of the stimulation treatment, the perforation cluster ratio calculated for the stage may be used to modify (e.g., averaged, applied within a weighted average, and/or the like) the current minimum perforation cluster ratio value.

In some embodiments, the minimum perforation cluster ratio value may be determined based on a user input. The user input may be received via an input device, such as a keyboard, mouse, button, touchscreen, in communication with the injection control subsystem 111, for example. In some cases, the user input may be received as a design parameter for the baseline treatment plan.

If, at block 208, the perforation cluster ratio for the current stage is less than the minimum perforation cluster ratio value, the perforation cluster spacing of the stimulation treatment at the treatment wellbore (e.g., wellbore 102) may be adjusted (e.g., increased) in block 210. In particular, the spacing between perforation clusters 122 employed by the treatment wellbore wellbore 102) may be increased for a subsequent stage (e.g., a stage following the current stage)) in comparison with the current stage. In some cases, a treatment parameter corresponding to the spacing of the perforation clusters 122 within the subsequent stage may be adjusted so that the subsequent stage may be performed according to the adjusted treatment parameter. More specifically, adjusting the spacing of the perforation clusters 122 within a stage may involve adjusting the total number of perforation clusters 122 within the stage, the number of perforation points within each perforation cluster 122 within the stage, the length of the stage (e.g., stage length 120), and/or the respective treatment parameters corresponding thereto. For example, by increasing the stage length 120 and/or reducing the total number of perforation clusters 122 within the current stage, the space between perforation clusters may be increased. Additionally or alternatively, adjusting the spacing of the perforation clusters 122 within a stage may involve removing, deactivating, relocating, and/or reconfiguring equipment, such as perforation guns, bridge plugs, and/or packers. In some embodiments, for example, the injection control subsystem 111 may transmit a signal (e.g., a control signal) to downhole equipment to actuate and/or otherwise cause the downhole equipment to adjust the spacing of the perforation clusters 122. For instance, the injection control subsystem 111 may be configured to employ automated control of the configuration of the downhole equipment or the injection control subsystem 111 may configure the downhole equipment based on a user input.

In some embodiments, the perforation cluster spacing within the current stage may be adjusted. For instance, after a first portion of the current stage is performed, the perforation cluster spacing may be determined (e.g., in block 206) and compared against the minimum perforation cluster ratio value (e.g., in block 208). If the perforation cluster ratio is less than the minimum perforation cluster ratio, one or more of the perforation clusters 122 within the current stage may be closed or otherwise sealed to prevent flow of treatment fluid through a subset of the perforation clusters. As an illustrative example, every other perforation cluster 122 within the current stage may be sealed. Accordingly, when a subsequent, second portion of the current stage is performed (e.g., additional treatment fluid is pumped), the spacing of the perforation clusters is increased compared to first portion of the current stage.

In some embodiments, adjustment of cluster spacing within the current stage or a subsequent stage may be performed in response to a user input. For instance, if the calculated perforation cluster ratio for the current stage is less than the minimum perforation cluster ratio (e.g., at block 208), a notification may be output to a user at an output device (e.g., a user device). The notification may cause the output device to produce a vibration, an audio signal, a visual, or a combination thereof. As an illustrative example, the notification may be a message, such as an email, short message service (SMS) message, push notification, an alert window (e.g., a dialog (box), and/or the like, output to a display. In some cases, the message may indicate that the perforation cluster spacing fails to satisfy a performance metric (e.g., that the calculated perforation cluster ratio is less than the minimum perforation cluster ratio). The message may additionally or alternatively provide a recommendation to adjust the perforation cluster spacing. The message may further provide an option, such as a button, to accept (e.g., confirm), reject, and/or override the recommendation to adjust the perforation cluster spacing. In response to a user input (e.g., via an input device) to accept or override the recommendation with an alternative adjustment to the perforation cluster spacing, the perforation cluster spacing may be adjusted based on the user input. In response to a user input rejecting the recommendation, the perforation cluster spacing may remain unchanged.

At block 212, the cumulative strain trace of the current stage may be compared with the cumulative strain trace of at least one previously performed stage of the stimulation treatment. Based on this comparison, whether or not inter-stage stimulated reservoir volume overlapping or reservoir by-passing exists between the current stage and at least one previously performed stage of the stimulation treatment may be determined at block 214, as described with reference to FIGS. 6A-6B and 7A-7D below.

Figure 6A:
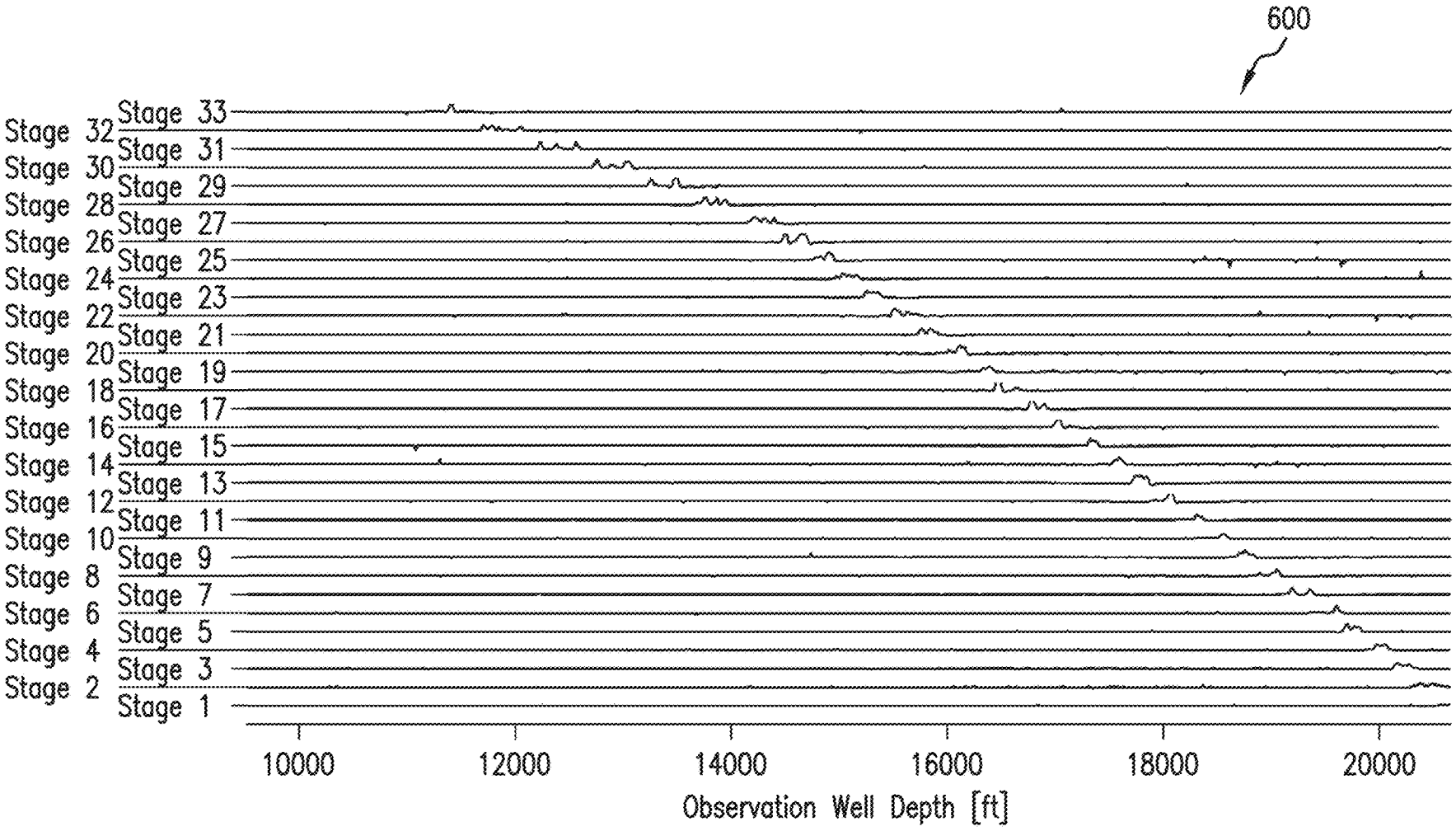
FIG. 6A is a plot of cumulative strain traces for a plurality of stages of a stimulation treatment in a stacked view against a common depth scale.

FIG. 6A illustrates a plot 600 of cumulative strain traces for a plurality of stages of a stimulation treatment. As illustrated, the plot 600 includes the cumulative strain traces in a stacked view against a common depth scale. Accordingly, overlap and/or gaps between stages at a particular depth within the subsurface formation 104 may be readily identified by, for example, visual inspection. More specifically, the cumulative strain values plotted in each cumulative strain trace may correspond to flow of treatment fluid detected at the observation wellbore 130 at a certain depth within the subsurface formation 104, as described herein. Accordingly, local maxima of the cumulative strain traces (e.g., positive cumulative strain values) repeatedly detected at the observation wellbore 130 at a particular depth of the subsurface formation 104 in association with different stages of the stimulation treatment, such as consecutive stages, may indicate redundant, repeated stimulation of a portion of the subsurface formation 104 over the stages (e.g., inter-stage stimulated reservoir volume overlapping). In some cases, for example, inter-stage stimulated reservoir volume overlapping may result from in-wellbore crossflow and/or stage isolation failure. On the other hand, the absence of local maxima of cumulative strains and/or positive cumulative strain values detected at the observation wellbore 130 at a particular depth of the subsurface formation 104 across stages of the stimulation treatment may indicate a gap where the subsurface formation 104 was not stimulated (e.g., inter-stage reservoir volume by-passing). To that end, inter-stage by-passing may result in missed (e.g., unrecovered) hydrocarbon reserves.

Figure 6B:
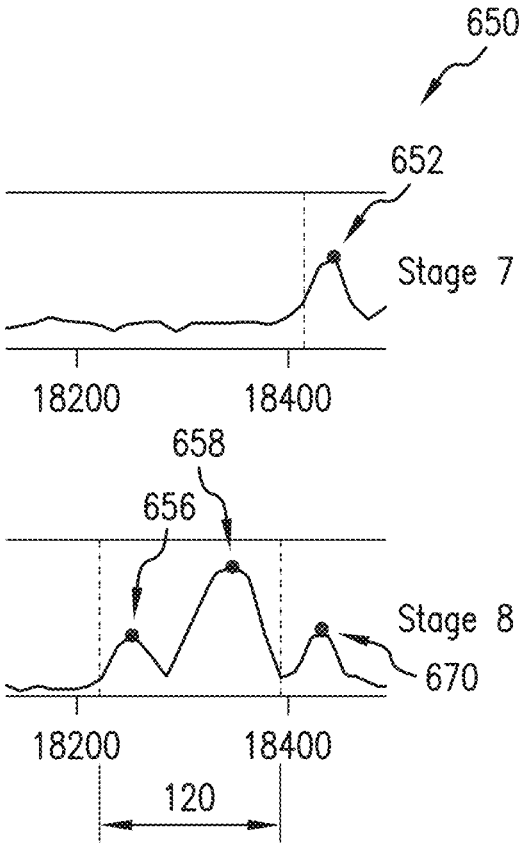
FIG. 6B is a detailed view of the cumulative strain traces from a portion of the plot of FIG. 6A.

An example of inter-stage stimulated reservoir volume overlapping is illustrated in the sub-plot 650 of FIG. 6B, which provides a detailed view of a portion of the plot 600 of FIG. 6A. For instance, the sub-plot 650 shows a first local maximum 652 detected at the observation wellbore 130 during stage 7 of a stimulation treatment. The sub-plot 650 further includes a second local maximum 656, a third local maximum 658, and a fourth local maximum 670 within the cumulative strain trace of stage 8 of the stimulation treatment. As shown, the second local maximum 656 and the third local maximum 658 of stage 8 stimulated the observation wellbore 130 at depths (e.g., between approximately 18,250 and 18,400 ft) previously unstimulated and/or lacking a maximum during stage 7. However, the fourth local maximum 670 corresponds to a depth (e.g., approximately 18,450 ft) that was previously stimulated at the observation wellbore 130 during stage 7, as shown by the first local maximum 652. The presence of the fourth local maximum 670 associated with stage 8 and the first local maximum 652 during stage 7 at a common depth indicates inter-stage stimulated volume overlapping.

Figure 7B:
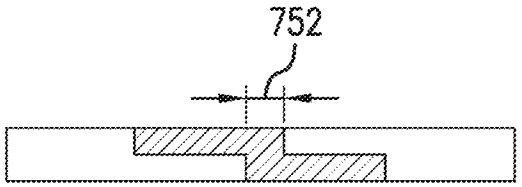
FIG. 7B is a color-coded plot of cumulative strain for two stages of a stimulation treatment illustrating inter-stage stimulated reservoir volume overlapping.
Figure 7C:
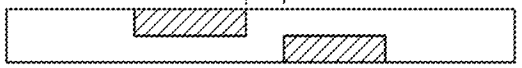
FIG. 7C is a color-coded plot of cumulative strain for two stages of a stimulation treatment illustrating inter-stage reservoir volume by-passing.
Figure 7D:
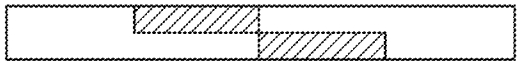
FIG. 7D is a color-coded plot of cumulative strain for two stages of a stimulation treatment illustrating an ideal stage length relationship between the two stages.
Figure 7A:
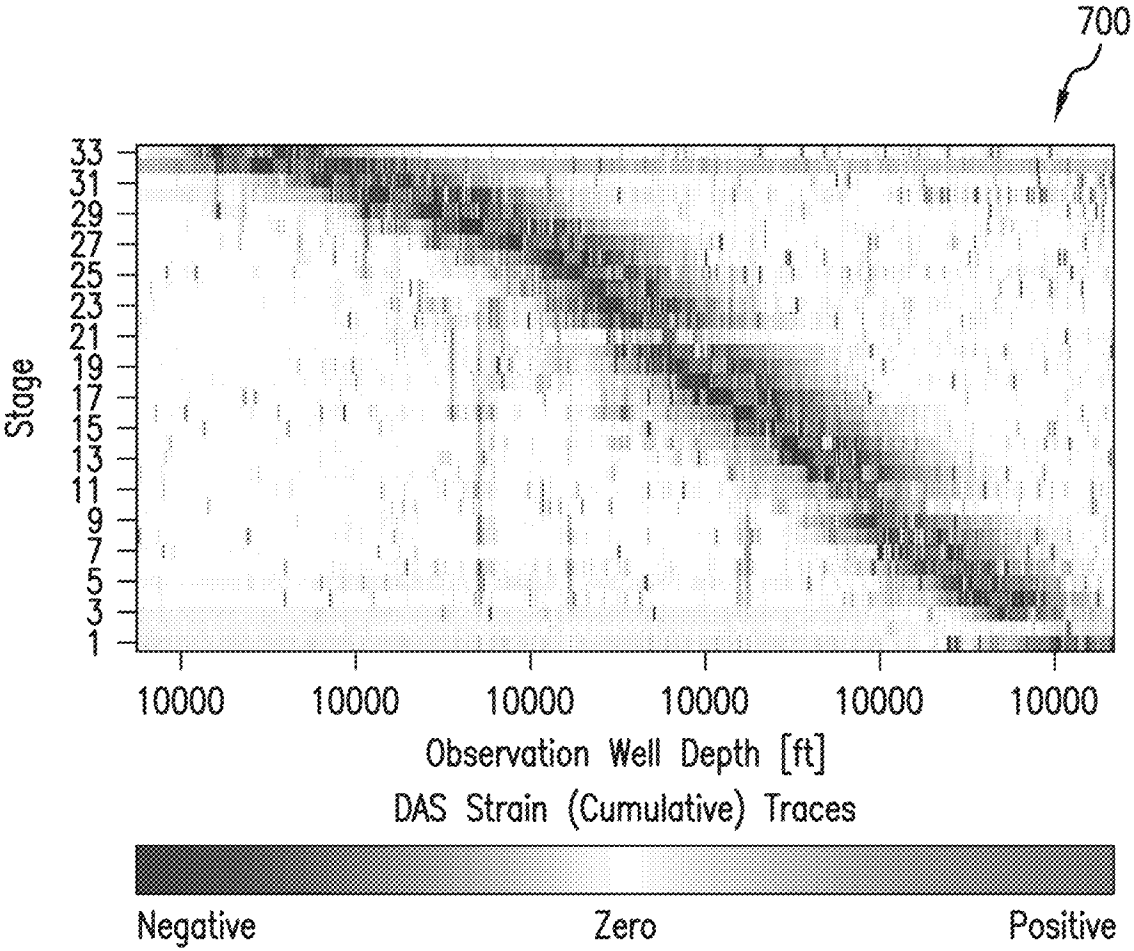
FIG. 7A is a color-coded plot of cumulative strain for a plurality of stages of a stimulation treatment plotted against a common depth.

FIGS. 7A-D illustrate color-coded plots (e.g., heatmaps) illustrating cumulative strain traces of the stages of the stimulation treatment plotted against a common depth. For instance, FIG. 7A illustrates a color-coded plot 700 of the cumulative traces of a plurality of stages of the stimulation treatment. FIG. 7B illustrates an example of inter-stage stimulated reservoir overlapping. That is, for example, the positive portions (e.g., the portions illustrated with cross-hatching) of two cumulative strain traces (e.g., a top and a bottom trace) corresponding to two stages of the stimulation treatment overlap over the range 752 associated with a common depth. In some cases, the inter-stage reservoir overlapping may result from stage isolation failure in one or both of the stages. FIG. 7C illustrates an example of inter-stage reservoir by-passing. For instance, within the range 762 associated with a common depth, a positive cumulative strain trace value is absent. To that end, treatment fluid pumped in both of the represented stages may have failed to reach the portion of the subsurface formation 104 (e.g., reservoir) corresponding to the depth within the range 762. FIG. 7D, on the other hand, illustrates an ideal relationship between the cumulative strain traces of two consecutive stages of the stimulation treatment. As illustrated, this relationship minimizes both inter-stage stimulated reservoir volume overlapping (e.g., as illustrated in FIG. 7B) and inter-stage reservoir volume bypassing (e.g., as illustrated in FIG. 7C). As a result, the stimulation treatment may maximize recovery of hydrocarbon reserves and minimize the treatment fluid used to do so.

In some embodiments, the extent of inter-stage stimulated reservoir volume overlapping or reservoir volume by-passing may be quantified. For example, a stage length variable (L) may be used to represent inter-stage stimulated reservoir volume overlapping and reservoir volume by-passing. In some embodiments, a positive value of the stage length variable may represent inter-stage stimulated reservoir volume, a negative value of the stage length variable may represent reservoir volume by-passing, and a zero value may represent minimized inter-stage overlap or by-passing (e.g., as illustrated in FIG. 7D). For instance, the range 752 may be mapped to a positive value of the stage length variable, the range 762 may be mapped to a negative value of the stage length variable, and the range 772 illustrated in FIG. 7D may be mapped to a zero value. Moreover, the range 752 may be mapped to the positive value of the stage length variable based on the range 752 exceeding a first threshold, the range 762 may be mapped to the negative value of the stage length variable based on the range 762 being less than a second threshold, and the range 772 may be mapped to a zero value of the stage length variable based on the range 772 falling between the first and second threshold (e.g., the range 772 being less than the first threshold and greater than the second threshold). Additionally or alternatively, the value of the stage length variable for the current stage may be determined based on a measure of similarity (e.g., correlation) between the cumulative strain trace of the current stage and the cumulative strain trace of a previous stage at a depth associated with the stage length 120 of the previous stage and not associated with the stage length 120 of the current stage.

Further, in some embodiments, inter-stage overlapping (e.g., as illustrated in FIG. 7B) resulting from in-wellbore communication may be distinguished from formation crossflow. For instance, using DAS measurements and/or DTS obtained (e.g., via the injection tools 116) below a plug in the wellbore 102 (e.g., the treatment wellbore) in one or both of the stages where inter-stage overlapping is detected, the overlapping may be diagnosed as resulting from in-wellbore communication or formation crossflow. Additionally or alternatively, early micro-seismic activity in front of the previous stage with respect to the overlap may be used to identify the inter-stage overlapping as related to in-wellbore communication or formation crossflow. Moreover, in some cases, pressure gauges in the wellbore 102 may be utilized to detect pressure changes indicative of stage isolation failure.

Returning now to FIG. 2, at block 214 inter-stage stimulated reservoir volume overlapping or reservoir by-passing between the current stage and the at least one previously performed stage of the stimulation treatment may be identified, if present, based on the comparison at block 212. To that end, the depth at which local maxima identified within cumulative strain traces of the current stage and at least one previous stage occur may be compared to identify overlapping local maxima or gaps between local maxima between the stages. Additionally or alternatively, the value of the stage length variable (L) corresponding to the current stage may be determined and/or compared against the zero-value described above. Moreover, because the inter-stage overlapping and by-passing may result from the stage lengths (e.g., stage lengths 120) of the stages of the stimulation treatment, determining whether inter-stage overlapping or by-passing is present between the current stage and a previously performed stage may correspond to determining whether a stage length used in the stimulation treatment is satisfactory or should be adjusted. That is, for example, block 214 may correspond to determining whether the performance of the stimulation treatment during the current stage satisfies a performance metric associated with the stage length of the current stage.

If, at block 214 inter-stage overlapping or by-passing is identified between the current stage and a pervious stage (e.g., the stage length of the current stage fails to satisfy a performance metric), the stage length of a subsequent stage (e.g., a stage consecutively following the current stage) may be adjusted at block 216. In particular, if inter-stage stimulated reservoir volume overlapping is identified at block 214, the stage length used at the treatment wellbore (e.g., wellbore 102) for the subsequent stage may be increased relative to the stage length of the current stage, and if inter-stage reservoir gapping is identified at block 214, the stage length of the subsequent stage may be decreased relative to the stage length of the current stage. In some cases, a treatment parameter corresponding to the stage length of the subsequent stage may be adjusted so that the subsequent stage may be performed according to the adjusted treatment parameter. Additionally or alternatively, adjusting the stage length of the subsequent stage may involve removing, deactivating, and/or relocating bridge plugs, packers and/or other types of equipment between a section 118 corresponding to the current stage and a section 118 corresponding to the subsequent stage. In some embodiments, for example, the injection control subsystem 111 may transmit a signal (e.g., a control signal) to downhole equipment to actuate and/or otherwise cause the downhole equipment to adjust the boundary of the section 118 corresponding to the subsequent stage to adjust the stage length 120 of the subsequent stage. For instance, the injection control subsystem 111 may be configured to employ automated control of the configuration of the downhole equipment.

In some embodiments, adjustment of stage length (e.g., block 216) may be performed in response to a user input. For instance, if inter-stage overlapping or by-passing is identified between the current stage and a previous stage (e.g., at block 214), a notification may be output to a user at an output device (e.g., a user device). The notification may cause the output device to produce a vibration, an audio signal, a visual, or a combination thereof. As an illustrative example, the notification may be a message, such as an email, short message service (SMS) message, push notification, an alert window (e.g., a dialog box), and/or the like, output to a display. In some cases, the message may indicate that the stage length of the current stage fails to satisfy a performance metric (e.g., that inter-stage overlapping or by-passing has been identified). The message may additionally or alternatively provide a recommendation to adjust the stage length of a subsequent stage. The message may further provide an option, such as a button, to accept (e.g., confirm), reject, and/or override the recommendation to adjust the stage length of the previous stage. In response to a user input (e.g., via an input device) to accept or override the recommendation with an alternative adjustment to the stage length 120, the stage length 120 may be adjusted based on the user input. In response to a user input rejecting the recommendation, the stage length 120 may remain unchanged.

Moreover, in some embodiments, the stage spacing between the current stage and the subsequent stage and/or the selection (e.g., size, type, quantity, placement, and/or the like) of plugs within the subsequent stage may be adjusted at block 216. To that end, while embodiments described herein refer to the adjustment of stage length 120, embodiments are not limited thereto.

At block 218, if one or more stages of the stimulation treatment remain, the next stage (e.g., a subsequent stage) of the stimulation treatment may be performed. More specifically, the next stage may be performed in accordance with treatment parameters corresponding to perforation cluster spacing and stage length. To that end, if the calculated perforation cluster ratio for the current stage is greater than or equal to the minimum perforation cluster ratio value (e.g., at block 208) and the inter-stage overlapping and by-passing are not identified between the current stage and a previous stage (e.g., at block 214), the next stage may be performed in accordance with a baseline treatment plan. On the other hand, if the calculated perforation cluster ratio for the current stage is less than the minimum perforation cluster ratio value (e.g., at block 208) and/or the inter-stage overlapping or by-passing are identified between the current stage and a previous stage (e.g., at block 214), the next stage may be performed in accordance with a modified treatment plan. In particular, the modified treatment plan may incorporate an adjustment to the cluster spacing corresponding to block 210 and/or an adjustment to the stage length 120 corresponding to block 216. Accordingly, the stimulation treatment may maximize perforation cluster and stage length efficiency (e.g., improve hydrocarbon recovery) while minimizing unnecessary use of treatment fluid or other materials pumped or injected into the subsurface formation over the course of the entire treatment. In this way, waste of the stimulation treatment is reduced and cost savings in terms of time and resources (e.g.; treatment fluid) may be improved. Moreover, the process 200 may be performed based on data collected at the wellbore 102 with flow allocation data and/or based on far-field strain data collected at an observation well (e.g., cross well communication).

While the process 200 is described herein as being performed during a stimulation treatment, embodiments are not limited thereto. For instance, in some cases, the process 200 may be performed after the stimulation treatment is complete. To that end, a post-processing analysis of one or more of the stages within the stimulation treatment may be performed to evaluate the performance of the perforation cluster spacing and/or the stage length 120 of the one or more stages. This analysis may then be used in the design of another treatment plan.

Moreover, while the process 200 is described herein as monitoring and controlling treatment parameters, such as stage length and/or perforation cluster spacing, embodiments are not limited thereto. For instance, the treatment fluid injection rate and/or pump rate, the treatment fluid volume, the treatment fluid type and/or composition, and/or the like may additionally or alternatively be adjusted based on the cumulative strain calculated (e.g., at block 204) for the current stage of stimulation treatment.

In addition, while the perforation cluster ratio and the techniques described herein are described at a granularity of perforation clusters, embodiments are not limited thereto. In some embodiments, for example, the number of perforation points within a given perforation cluster may additionally or alternatively be used to determine the performance of a stage. In some embodiments, the perforation cluster ratio may be redefined based on flow allocation peaks, as described in greater detail with respect to FIG. 8 and Equation 3 below. For instance, clusters may be grouped (e.g., represented) based on the number of local maxima identified within a flow allocation trace. Moreover, the number of perforation points within a perforation cluster may be adjusted based on the cumulative strain calculated for the current stage.

Further, while FIGS. 3-5, 6A-6B, and 7A-7D are described above with reference to performance of calculations, comparisons, determinations, and/or the like, it should be appreciated that plot 300, plot 400, trace 500, detailed view 502, plot 600, sub-plot 650, and/or plot 700 may additionally or alternatively be output to a display. For instance, in some embodiments, plot 300, plot 400, trace 500, detailed view 502, plot 600, sub-plot 650, and/or plot 700 may be included in a graphical user interface (GUI), which may facilitate user analysis of the stimulation treatment. Further, in some cases, the plot 300, plot 400, trace 500, detailed view 502, plot 600, sub-plot 650, and/or plot 700 may be included in a notification output to the user (e.g., via an output device). For instance, the notification may be provided in response to the determination that the calculated perforation cluster ratio for a current stage is less than the minimum perforation cluster ratio (e.g., at block 208) and/or in response to the identification of inter-stage overlapping or by-passing (e.g., at block 216), as described above.

Figure 8:
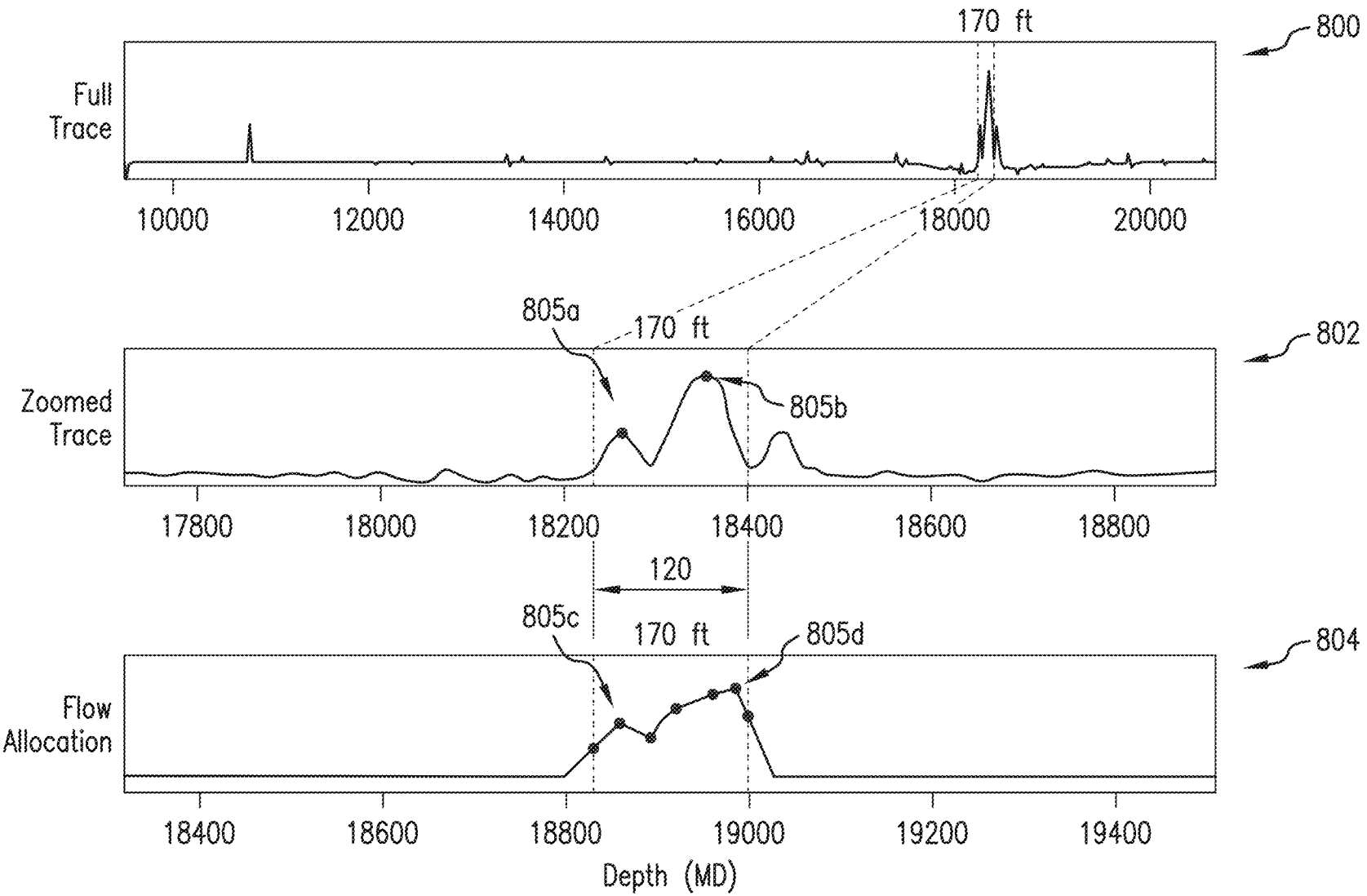
FIG. 8 is a cumulative strain trace and a flow allocation trace for a stage of a stimulation treatment.

FIG. 8 illustrates a cumulative strain trace 800 for a stage of a stimulation treatment. As further illustrated, a sub-plot 802 of a portion of the cumulative strain trace 800 is depicted alongside a flow allocation trace 804 corresponding to the stage of the stimulation treatment. As described herein, the cumulative strain trace 800 and the resulting sub-plot 802 may be determined based on DAS measurements, which may be obtained via sensors positioned within the observation wellbore 130 (e.g., a far-field wellbore). The flow allocation trace 804 may be determined based on measurements, such as flow, pressure, and/or velocity measurements, of treatment fluid at the wellbore 102 (e.g., near-wellbore measurements). For instance, the flow allocation trace 804 may illustrate the volume of treatment fluid delivered to a particular depth within the stage and may be determined based on near-wellbore DAS measurements, data collected from point sensors, and/or the like. Further, the flow allocation trace 804 illustrates cluster flow (e.g., proppant allocation) resulting from the injection of treatment fluids in the wellbore 102 for the stage of stimulation treatment. To that end, the flow allocation trace 804 indicates near-wellbore completion performance.

Moreover, since the flow allocation trace is also associated with the flow of treatment fluid from the wellbore 102 via perforation clusters, the perforation cluster ratio, denoted as R, may be additionally or alternatively be determined and/or redefined using Equation (3) as shown below:

$$R = \frac{\text{\# of Strain Peaks}}{\text{\# of Flow Peaks}} \tag{3}$$

where the numerator (# of strain peaks) corresponds to the number of local maxima (e.g., peak values of cumulative strain) identified within the cumulative strain trace for the current stage, and the denominator (# of flow peaks) corresponds to the number of local maxima identified within flow allocation trace for the current stage. To that end, the process 200 and/or the techniques described herein may be employed based on the definition of the perforation cluster ratio provided by Equation 3.

Further, because each of the cumulative strain trace 800 and the flow allocation trace 804 may be associated with flow of treatment fluid from the wellbore 102 via perforation clusters into the subsurface formation for the stage of the stimulation treatment, a comparison of the cumulative strain trace 800 and the flow allocation trace 804 may validate the usefulness (e.g., reliability) and/or accuracy of the cumulative strain trace 800 and/or the flow allocation trace 804. For instance, in the illustrated embodiment, the sub-plot 802 includes two local maxima corresponding to points 805*a* and 805*b*, respectively, and the flow allocation trace 804 includes two local maxima corresponding to points 805*c* and 805*d*, respectively. The two local maxima (e.g., at points 805*a* and 805*b* and at points 805*c* and 805*d*, respectively) within the stage length 120 of the stage in each of the sub-plot 802 and the flow allocation trace 804 indicate a positive correlation between the two datasets. If, however, the number of local maxima within and/or the general shape of the curves (802, 804) for the stage vary, the data corresponding to the cumulative strain trace 800 (e.g., the DAS measurements collected at a far-field wellbore), the data corresponding to the flow allocation trace 804, or both may include an error. That is, for example, data corresponding to the illustrated cumulative strain trace 800 and flow allocation trace 804 may be more reliable than data corresponding to a cumulative strain trace and/or flow allocation trace 804 that are dissimilar (e.g., vary in a number of local maxima, a general shape, and/or the like).

Figure 9B:
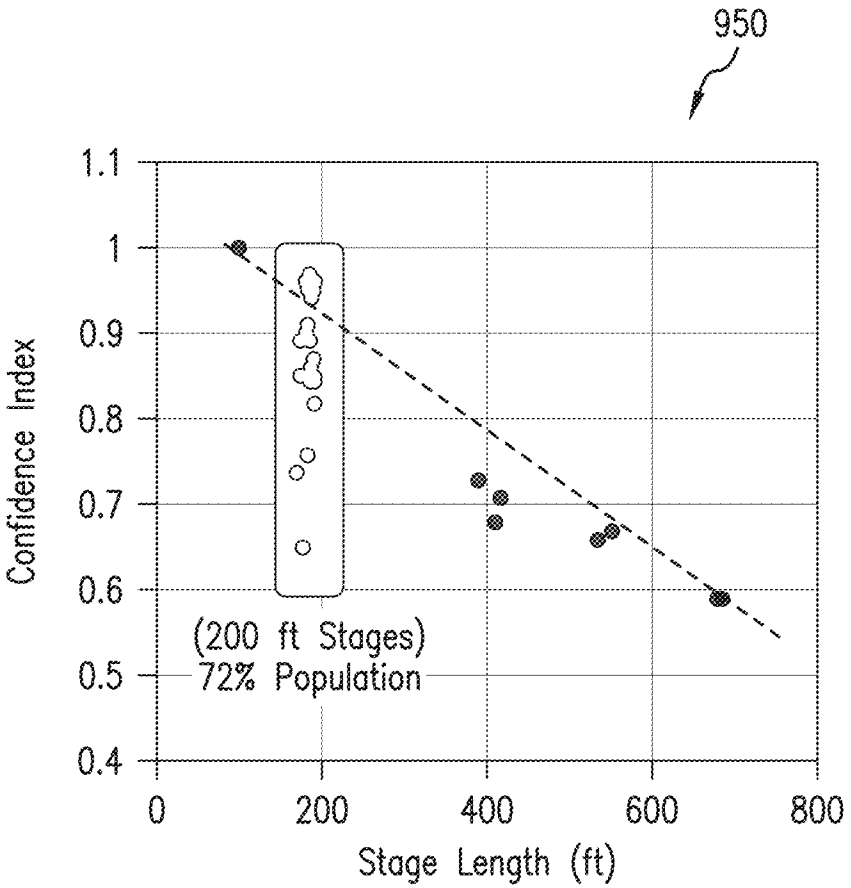
FIG. 9B is a plot of confidence indices corresponding measurements taken for respective stages of a stimulation treatment plotted against the stage length of the respective stage.
Figure 9A:
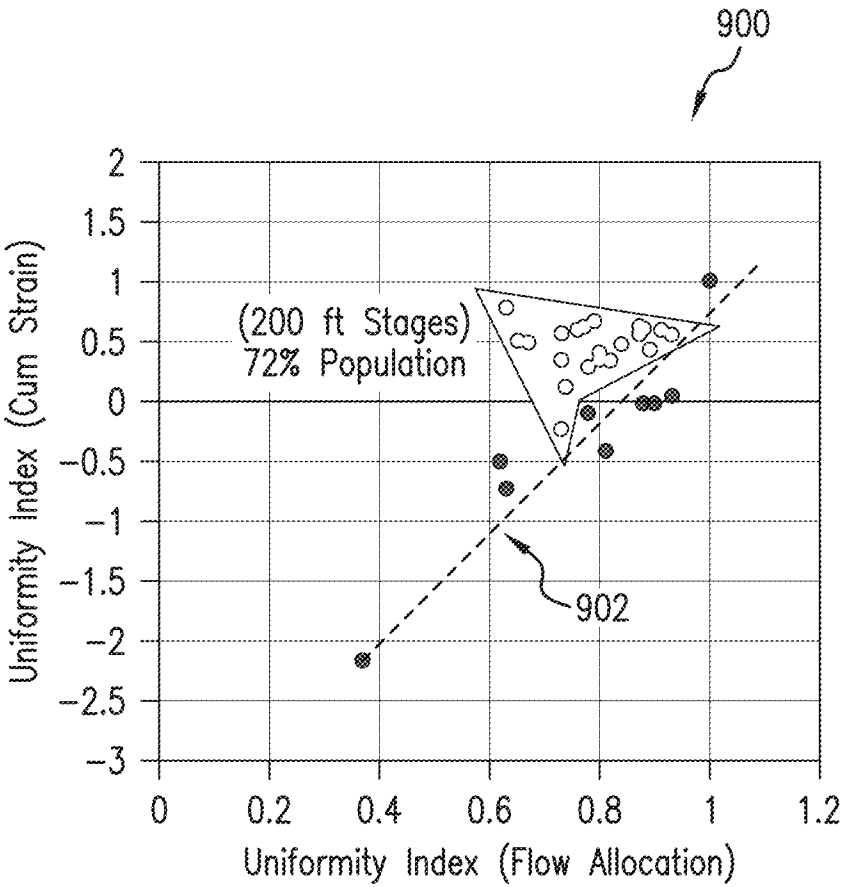
FIG. 9A is a plot of a uniformity index corresponding to cumulative strain of a stage of a stimulation treatment against a uniformity index corresponding to flow allocation of the stage.

Turning now to FIG. 9A, a relationship (e.g., comparison) between a cumulative strain trace and a corresponding flow allocation trace, such as cumulative strain trace 800 and flow allocation trace 804, may be quantified, as shown in the plot 900. Plot 900 graphs a uniformity index corresponding to cumulative strain of a stage against a uniformity index corresponding to flow allocation of the stage. In some embodiments, for example, the uniformity index corresponding to the cumulative strain of the stage may be determined based on a cumulative strain trace of the stage, and the uniformity index corresponding to the flow allocation of the stage may be determined based on a flow allocation trace of the stage, as illustrated and described above with reference to FIG. 8. In particular, the uniformity indices may measure the uniformity of flow distribution of treatment fluid across the perforation clusters 122 within the stage, where a uniformity index of 1 indicates uniformity and indices with lower values indicate a greater lack of uniformity. As an illustrative example, if 1000 gallons of treatment fluid is pumped through a stage with five perforation clusters 122, a uniform distribution of the treatment fluid (e.g., resulting in a uniformity index values near 1) would result in 200 gallons of the treatment fluid flowing through each of the perforation clusters 122. On the other hand, a non-uniform distribution of the treatment fluid (e.g., resulting in a relatively low values index magnitude) may result in the 1000 gallons of the treatment fluid flowing through only a single perforation cluster 122.

In some embodiments, the uniformity indices may be determined based on the number of perforation clusters 122 within the stage, as well as the respective cumulative strain or flow allocation trace for the stage. In particular, based on the number of perforation clusters 122 within the stage, as well as the shape (e.g., the number and/or location of local maxima, the area under the curve, the slope, and/or the like) of the respective cumulative strain or flow allocation trace, the uniformity indices may be determined for the stage. In some embodiments, for example, the uniformity indices may be calculated based on a standard deviation and/or a mean associated with the cumulative strain or flow allocation trace. In the illustrated plot 900, the linear relationship between the uniformity indices corresponding to cumulative strain and uniformity indices corresponding to flow allocation is shown by the dashed line 902. That is, for example, the line 902 illustrates the correlation a normalized cross-correlation) between far-field based cumulative strain measurements and near-wellbore flow allocation measurements. This correlation is more readily apparent with the exclusion of data from stages having a nominal stage length (e.g., approximately 200 feet (ft)). As such, the data corresponding to stages with a stage length of approximately 200 ft is illustrated as grouped and shown in another color.

Using a uniformity index corresponding to a cumulative strain and a uniformity index corresponding to a flow allocation for a stage, a confidence index (e.g., a similarity and/or likeness metric) may be determined. For instance, the data points shown in the plot 900 of FIG. 9A may be mapped to the confidence index. In some embodiments, the confidence index may correspond to a normalized cross correlation and/or a uniformity indices ratio between the cumulative strain and flow allocation measurements for a stage. Moreover, the confidence index may be used to indicate a level of confidence (e.g., to endorse) associated with the accuracy and/or validity of the cumulative strain measurements. For instance, the confidence index may indicate a level of similarity between a cumulative strain trace and a flow allocation trace for the stage. In some embodiments, a confidence index value of 1 may indicate a high degree of similarity between the cumulative strain trace and the flow allocation trace for the stage, and confidence index values trending toward 0 may indicate decreasing degrees of similarity between the cumulative strain trace and the flow allocation trace for the stage. To that end, a confidence index value of 1 may represent a high level of confidence associated with the accuracy and/or validity of the cumulative strain measurements, while a confidence index values trending toward 0 may represent decreasing levels of confidence associated with the accuracy and/or validity of the cumulative strain measurements.

FIG. 9B illustrates a plot 950 of confidence indices corresponding to respective stages plotted against the stage length of the respective stage. As described with reference to FIG. 9A, the data corresponding to stages with a stage length of approximately 200 ft is illustrated within the plot 950 as grouped and shown in another color.

In some embodiments, the confidence index for a stage may be used to endorse (e.g., validate) calculations made using the cumulative strain trace, such as the calculation of the perforation cluster ratio for the current stage (e.g., block 206 of FIG. 2) and/or the determination of whether inter-stage overlapping or by-passing is present between the stage and a previous stage (e.g., block 212 and/or 214). Additionally or alternatively, the confidence index may be used to validate calculations made using the flow allocation trace. In some embodiments, for example, a calculation made using the cumulative strain trace may be discarded or may be omitted (e.g., may not be performed) if the confidence index falls below a threshold value. For instance, portions of the process 200, such as block 206, 208, 212, and/or 214, may be omitted in response to the confidence index for the current stage falling below the threshold value. To that end, while not illustrated, the process 200 may involve determining the confidence index associated with the cumulative strain trace after calculating the cumulative strain trace (e.g., at block 204). Additionally or alternatively, the process 200 may involve providing an indication of the confidence index associated with the cumulative strain trace so that a recommendation to adjust the perforation cluster spacing (e.g., in accordance with block 210) and/or the stage length (e.g., in accordance with block 216) may be interpreted and/or weighted against the confidence index.

While FIGS. 9A-9B are illustrated and described with reference to uniformity indices, embodiments are not limited thereto. To that end, any suitable measure of statistical dispersion, such as standard deviation, variance, range, interquartile range, coefficient of variation, coefficient of quartile variation, and/or the like may be used to illustrate characteristics of the flow distribution determined based on cumulative strain or flow allocation traces and the relationship between these different methods of determining flow distribution.

Any of trace 800, sub-plot 802, trace 804, detailed view 502, plot 900, and plot 950 may be output to a display. For instance, in some embodiments, trace 800, sub-plot 802, trace 804, detailed view 502, plot 900, and plot 950 may be included in a GUI. To that end, the trace 800, sub-plot 802, trace 804, detailed view 502, plot 900, and plot 950 may be provided in the GUI to provide an endorsement of calculations and/or determinations made with respect to the process 200 of FIG. 2. Further, in some cases, trace 800, sub-plot 802, trace 804, detailed view 502, plot 900, and plot 950 may be included in a notification output to the user (e.g., via an output device). For instance, the notification may be provided in response to the determination that the calculated perforation cluster ratio for a current stage is less than the minimum perforation cluster ratio (e.g., at block 208) and/or in response to the identification of inter-stage overlapping or by-passing (e.g., at block 216), as described above.

Figure 10:
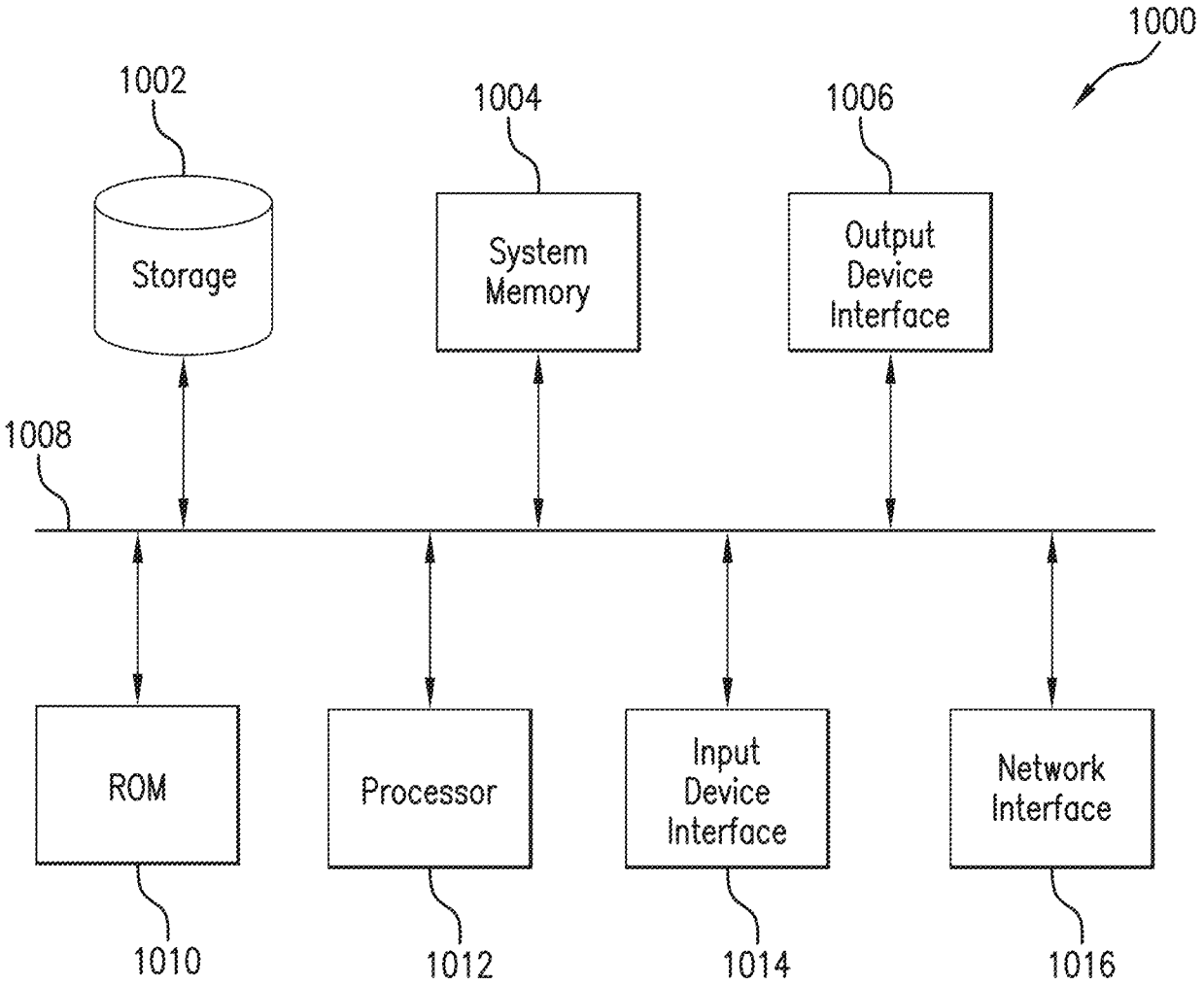
FIG. 10 is a block diagram of an illustrative computer system in which embodiments of the present disclosure may be implemented.

FIG. 10 is a block diagram of an exemplary computer system 1000 in which embodiments of the present disclosure may be implemented. For example, the injection control subsystem 111 (or data processing components thereof) of FIG. 1 and the steps of process 200 of FIG. 2, as described above, may be implemented using system 1000. System 1000 can be a computer, phone, PDA, or any other type of electronic device. Such an electronic device includes various types of computer readable media and interfaces for various other types of computer readable media. As shown in FIG. 10, system 1000 includes a permanent storage device 1002, a system memory 1004, an output device interface 1006, a system communications bus 1008, a read-only memory (ROM) 1010, processing unit(s) 1012, an input device interface 1014, and a network interface 1016.

Bus 1008 collectively represents all system, peripheral, and chipset buses that communicatively connect the numerous internal devices of system 1000. For instance, bus 1008 communicatively connects processing unit(s) 1012 with ROM 1010, system memory 1004, and permanent storage device 1002.

From these various memory units, processing unit(s) 1012 retrieves instructions to execute and data to process in order to execute the processes of the subject disclosure. The processing unit(s) can be a single processor or a multi-core processor in different implementations.

ROM 1010 stores static data and instructions that are needed by processing unit(s) 1012 and other modules of system 1000. Permanent storage device 1002, on the other hand, is a read-and-write memory device. This device is a non-volatile memory unit that stores instructions and data even when system 1000 is off. Some implementations of the subject disclosure use a mass-storage device (such as a magnetic or optical disk and its corresponding disk drive) as permanent storage device 1002.

Other implementations use a removable storage device (such as a floppy disk, flash drive, and its corresponding disk drive) as permanent storage device 1002. Like permanent storage device 1002, system memory 1004 is a read-and-write memory device. However, unlike storage device 1002, system memory 1004 is a volatile read-and-write memory, such a random access memory. System memory 1004 stores some of the instructions and data that the processor needs at runtime. In some implementations, the processes of the subject disclosure are stored in system memory 1004, permanent storage device 1002, and/or ROM 1010. For example, the various memory units include instructions for performing process 200 and/or for instructing (e.g., control signals to instruct) injection tools 116 to adjust treatment parameters, such as stage length and/or perforation cluster spacing, in accordance with some implementations. From these various memory units, processing unit(s) 1012 retrieves instructions to execute and data to process in order to execute the processes of some implementations.

Bus 1008 also connects to input and output device interfaces 1014 and 1006. Input device interface 1014 enables the user to communicate information and select commands to the system 1000. Input devices used with input device interface 1014 include, for example, alphanumeric, QWERTY, or T9 keyboards, microphones, and pointing devices (also called "cursor control devices"). Output device interfaces 1006 enables, for example, the display of images generated by the system 1000. Output devices used with output device interface 1006 include, for example, printers and display devices, such as cathode ray tubes (CRT) or liquid crystal displays (LCD). Some implementations include devices such as a touchscreen that functions as both input and output devices. It should be appreciated that embodiments of the present disclosure may be implemented using a computer including any of various types of input and output devices for enabling interaction with a user. Such interaction may include feedback to or from the user in different forms of sensory feedback including, but not limited to, visual feedback, auditory feedback, or tactile feedback. Further, input from the user can be received in any form including, but not limited to, acoustic, speech, or tactile input. Additionally, interaction with the user may include transmitting and receiving different types of information, e.g., in the form of documents, to and from the user via the above-described interfaces.

Also, as shown in FIG. 10, bus 1008 also couples system 1000 to a public or private network (not shown) or combination of networks through a network interface 1016. Such a network may include, for example, a local area network ("LAN"), such as an Intranet, or a wide area network ("WAN"), such as the Internet. Any or all components of system 1000 can be used in conjunction with the subject disclosure.

These functions described above can be implemented in digital electronic circuitry, in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

Some implementations include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, read-only and recordable Blu-Ray® discs, ultra density optical discs, any other optical or magnetic media, and floppy disks. The computer-readable media can store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, such as application specific integrated circuits (ASICs) or field programmable gate arrays (FPGAs). In some implementations, such integrated circuits execute instructions that are stored on the circuit itself. Accordingly, the steps of process 200 of FIG. 2, as described above, may be implemented using system 1000 or any computer system having processing circuitry or a computer program product including instructions stored therein, which, when executed by at least one processor, causes the processor to perform functions relating to these methods.

As used in this specification and any claims of this application, the terms "computer", "server", "processor", and "memory" all refer to electronic or other technological devices. These terms exclude people or groups of people. As used herein, the terms "computer readable medium" and "computer readable media" refer generally to tangible, physical, and non-transitory electronic storage mediums that store information in a form that is readable by a computer.

Embodiments of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), an internetwork (e.g., the Internet), and peer-to-peer networks (e.g., ad hoc peer-to-peer networks).

The computing system can include clients and servers. A client and server are generally remote from each other and typically interact through a communication network. The relationship of client and server arises by virtue of computer programs running on the respective computers and having a client-server relationship to each other. In some embodiments, a server transmits data (e.g., a web page) to a client device (e.g., for purposes of displaying data to and receiving user input from a user interacting with the client device).

Data generated at the client device (e.g., a result of the user interaction) can be received from the client device at the server.

It is understood that any specific order or hierarchy of steps in the processes disclosed is an illustration of exemplary approaches. Based upon design preferences, it is understood that the specific order or hierarchy of steps in the processes may be rearranged, or that all illustrated steps be performed. Some of the steps may be performed simultaneously. For example, in certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Furthermore, the exemplary methodologies described herein may be implemented by a system including processing circuitry or a computer program product including instructions which, when executed by at least one processor, causes the processor to perform any of the methodology described herein.

As described above, embodiments of the present disclosure are particularly useful for optimizing perforation cluster spacing and/or stage lengths over stages during stimulation treatments. In one embodiment of the present disclosure, a method includes: acquiring distributed acoustic sensing (DAS) measurements at an observation wellbore during a current stage of a stimulation treatment along a treatment wellbore within a reservoir formation; calculating a cumulative strain trace for the current stage of the stimulation treatment based on the acquired DAS measurements; determining whether to adjust a spacing of perforation clusters used at the treatment wellbore in the stimulation treatment, based on the cumulative strain trace for the current stage and a number of perforation clusters included within the current stage; determining whether to adjust a stage length used at the treatment wellbore in the stimulation treatment, based on a comparison between the cumulative strain trace for the current stage and a previously calculated cumulative strain trace for a previous stage of the stimulation treatment along the treatment wellbore; responsive to determining to adjust the spacing of the perforation clusters or to adjust the stage length, adjusting at least one treatment parameter for a subsequent stage of the stimulation treatment along the treatment wellbore; and performing the subsequent stage based on the adjusted at least one treatment parameter.

In one or more embodiments of the foregoing method: the method includes identifying local maxima within the cumulative strain trace; the determining whether to adjust the spacing of the perforation clusters includes: comparing a ratio of a number of the identified local maxima and the number of perforation clusters included within the current stage to a minimum perforation cluster ratio value; determining, based on the comparison of the ratio and the minimum perforation cluster ratio value, to adjust the spacing of the perforation clusters responsive to the ratio being less than the minimum perforation cluster ratio value; and determining, based on the comparison of the ratio and the minimum perforation cluster ratio value, to maintain the spacing of the perforation clusters responsive to the ratio being greater than or equal to the minimum perforation cluster ratio value; the method includes determining whether to adjust the spacing of the perforation clusters further based on a minimum perforation cluster ratio; the method includes determining the minimum perforation cluster ratio based on cumulative strain traces calculated for one or more initial stages of the stimulation treatment performed along the treatment wellbore prior to the current stage; the observation wellbore is positioned within a second reservoir formation that is different from the reservoir formation in which the treatment wellbore is located, and the method further includes determining the minimum perforation cluster ratio based at least partly on respective characteristics of the reservoir formation and the second reservoir formation; the determining whether to adjust the stage length includes: identifying local maxima within the cumulative strain trace for the current stage and the cumulative strain trace for the previous stage; and determining, based on a comparison of the identified local maxima, whether inter-stage stimulated reservoir volume overlapping or inter-stage reservoir volume by-passing occurred within the reservoir formation between the current stage and the previous stage during the stimulation treatment along the treatment wellbore; the adjusting the at least one treatment parameter includes: responsive to determining that inter-stage stimulated reservoir volume overlapping occurred between the current stage and the previous stage, increasing the stage length; and responsive to determining that inter-stage reservoir volume by-passing occurred between the current stage and the previous stage, decreasing the stage length; the observation wellbore is positioned within a second reservoir formation different from the reservoir formation in which the treatment wellbore is located; the method includes comparing the cumulative strain trace for the current stage to a flow allocation trace for the current stage acquired at the treatment wellbore; the adjusting the at least one treatment parameter includes adjusting one or more of a number of perforation clusters included in the subsequent stage relative to the current stage, a stage length of the subsequent stage relative to the current stage, or a stage spacing between the current stage and the subsequent stage.

In one embodiment of the present disclosure; a system is disclosed, where the system includes: a processor; and a memory having processor-readable instructions stored therein, which, when executed by the processor, cause the processor to perform a plurality of functions, including functions to: acquire distributed acoustic sensing (DAS) measurements at an observation wellbore during a current stage of a stimulation treatment along a treatment wellbore within a reservoir formation; calculate a cumulative strain trace for the current stage of the stimulation treatment based on the acquired DAS measurements; determine whether to adjust a spacing of perforation clusters used at the treatment wellbore in the stimulation treatment, based on the cumulative strain trace for the current stage and a number of perforation clusters included within the current stage; determine whether to adjust a stage length used at the treatment wellbore in the stimulation treatment, based on a comparison between the cumulative strain trace for the current stage and a previously calculated cumulative strain trace for a previous stage of the stimulation treatment along the treatment wellbore; responsive to determining to adjust the spacing of the perforation clusters or to adjust the stage length, adjust at least one treatment parameter for a subsequent stage of the stimulation treatment along the treatment wellbore; and perform the subsequent stage based on the adjusted of at least one treatment parameter.

In one or more embodiments of the foregoing system: the plurality of functions further includes functions to: responsive to determining to adjust the spacing of the perforation clusters or to adjust the stage length, output a notification for display at a user device; the plurality of functions further includes functions to: adjust the at least one treatment parameter for the subsequent stage of the stimulation treatment along the treatment wellbore further based on receiving, from the user device, a confirmation to adjust the at least one treatment parameter.

In another embodiment of the present disclosure, a computer-readable storage medium having computer-readable instructions stored therein, which, when executed by a computer, cause the computer to perform a plurality of functions, including functions to: acquire distributed acoustic sensing (DAS) measurements at an observation wellbore during a current stage of a stimulation treatment along a treatment wellbore within a reservoir formation; calculate a cumulative strain trace for the current stage of the stimulation treatment based on the acquired DAS measurements; determine whether to adjust a spacing of perforation clusters used at the treatment wellbore in the stimulation treatment, based on the cumulative strain trace for the current stage and a number of perforation clusters included within the current stage; determine whether to adjust a stage length used at the treatment wellbore in the stimulation treatment, based on a comparison between the cumulative strain trace for the current stage and a previously calculated cumulative strain trace for a previous stage of the stimulation treatment along the treatment wellbore; responsive to determining to adjust the spacing of the perforation clusters or to adjust the stage length, adjust at least one treatment parameter for a subsequent stage of the stimulation treatment along the treatment wellbore; and perform the subsequent stage based on the adjusted at least one treatment parameter.

In one or more embodiments of the foregoing computer-readable storage medium: the plurality of functions, further includes functions to: identify local maxima within the cumulative strain trace; the determining whether to adjust the spacing of the perforation clusters includes: comparing a ratio of a number of the identified local maxima and the number of perforation clusters included within the current stage to a minimum perforation cluster ratio value; determining, based on the comparison of the ratio and the minimum perforation cluster ratio value, to adjust the spacing of the perforation clusters responsive to the ratio being less than the minimum perforation cluster ratio value; and determining, based on the comparison of the ratio and the minimum perforation cluster ratio value, to maintain the spacing of the perforation clusters responsive to the ratio being greater than or equal to the minimum perforation cluster ratio value; the plurality of functions, further includes functions to: determine whether to adjust the spacing of the perforation clusters further based on a minimum perforation cluster ratio; the determining whether to adjust the stage length includes: identifying local maxima within the cumulative strain trace for the current stage and the cumulative strain trace for the previous stage; and determining, based on a comparison of the identified local maxima, whether inter-stage stimulated reservoir volume overlapping or inter-stage reservoir volume by-passing occurred between the current stage and the previous stage during the stimulation treatment along the treatment wellbore; the plurality of functions, further includes functions to: receive the DAS measurements via a fiber-optic sensor positioned within the observation wellbore.

While specific details about the above embodiments have been described, the above hardware and software descriptions are intended merely as example embodiments and are not intended to limit the structure or implementation of the disclosed embodiments. For instance, although many other internal components of the system 1000 are not shown, those of ordinary skill in the art will appreciate that such components and their interconnection are well known.

In addition, certain aspects of the disclosed embodiments, as outlined above, may be embodied in software that is executed using one or more processing units/components. Program aspects of the technology may be thought of as "products" or "articles of manufacture" typically in the form of executable code and/or associated data that is carried on or embodied in a type of machine readable medium. Tangible non-transitory "storage" type media include any or all of the memory or other storage for the computers, processors or the like, or associated modules thereof, such as various semiconductor memories; tape drives, disk drives, optical or magnetic disks, and the like, which may provide storage at any time for the software programming.

Additionally, the flowchart and block diagrams in the figures illustrate the architecture, functionality, and operation of possible implementations of systems, methods and computer program products according to various embodiments of the present disclosure. It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The above specific example embodiments are not intended to limit the scope of the claims. The example embodiments may be modified by including, excluding, or combining one or more features or functions described in the disclosure.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, integers, steps, operations, elements, and/or components, but do not preclude the presence or addition of one or more other features, integers, steps, operations, elements, components, and/or groups thereof. The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the embodiments in the form disclosed. Many modifications and variations will be apparent to those of ordinary skill in the art without departing from the scope and spirit of the disclosure. The illustrative embodiments described herein are provided to explain the principles of the disclosure and the practical application thereof, and to enable others of ordinary skill in the art to understand that the disclosed embodiments may be modified as desired for a particular implementation or use. The scope of the claims is intended to broadly cover the disclosed embodiments and any such modification.

What is claimed is:

1. A method comprising:

acquiring distributed acoustic sensing (DAS) measurements at an observation wellbore during a current stage of a stimulation treatment along a treatment wellbore within a reservoir formation;

calculating a cumulative strain trace for the current stage of the stimulation treatment based on the acquired DAS measurements;

determining whether to adjust a spacing of perforation clusters used at the treatment wellbore in the stimulation treatment, based on the cumulative strain trace for the current stage and a number of perforation clusters included within the current stage, wherein determining whether to adjust the spacing of the perforation clusters includes:

comparing a ratio of a number of identified local maxima and the number of perforation clusters included within the current stage to a minimum perforation cluster ratio value; and determining, based on the comparison of the ratio and the minimum perforation cluster ratio value, to adjust or maintain the spacing of the perforation clusters;

determining whether to adjust a stage length used at the treatment wellbore in the stimulation treatment, based on a comparison between the cumulative strain trace for the current stage and a previously calculated cumulative strain trace for a previous stage of the stimulation treatment along the treatment wellbore;

responsive to determining to adjust the spacing of the perforation clusters or to adjust the stage length, adjusting, based at least in part on the comparison of the ratio and the minimum perforation cluster ratio value, at least one treatment parameter for a subsequent stage of the stimulation treatment along the treatment wellbore; and performing the subsequent stage based on the adjusted at least one treatment parameter.

2. The method of claim 1, further comprising determining whether to adjust the spacing of the perforation clusters further based on a minimum perforation cluster ratio.

3. The method of claim 2, further comprising determining the minimum perforation cluster ratio based on cumulative strain traces calculated for one or more initial stages of the stimulation treatment performed along the treatment wellbore prior to the current stage.

4. The method of claim 2, wherein the observation wellbore is positioned within a second reservoir formation that is different from the reservoir formation in which the treatment wellbore is located, and the method further comprises:

determining the minimum perforation cluster ratio based at least partly on respective characteristics of the reservoir formation and the second reservoir formation.

5. The method of claim 1, wherein the determining whether to adjust the stage length includes:

identifying local maxima within the cumulative strain trace for the current stage and the cumulative strain trace for the previous stage; and determining, based on a comparison of the identified local maxima, whether inter-stage stimulated reservoir volume overlapping or inter-stage reservoir volume by-passing occurred within the reservoir formation between the current stage and the previous stage during the stimulation treatment along the treatment wellbore.

6. The method of claim 5, wherein the adjusting the at least one treatment parameter includes:

responsive to determining that inter-stage stimulated reservoir volume overlapping occurred between the current stage and the previous stage, increasing the stage length; and responsive to determining that inter-stage reservoir volume by-passing occurred between the current stage and the previous stage, decreasing the stage length.

7. The method of claim 1, wherein the observation wellbore is positioned within a second reservoir formation different from the reservoir formation in which the treatment wellbore is located.

8. The method of claim 1, further comprising comparing the cumulative strain trace for the current stage to a flow allocation trace for the current stage acquired at the treatment wellbore.

9. The method of claim 1, wherein the adjusting the at least one treatment parameter includes adjusting one or more of a number of perforation clusters included in the subsequent stage relative to the current stage, a stage length of the subsequent stage relative to the current stage, or a stage spacing between the current stage and the subsequent stage.

10. A system comprising:

a processor; and a memory having processor-readable instructions stored therein, which, when executed by the processor, cause the processor to perform a plurality of functions, including functions to:

acquire distributed acoustic sensing (DAS) measurements at an observation wellbore during a current stage of a stimulation treatment along a treatment wellbore within a reservoir formation;

calculate a cumulative strain trace for the current stage of the stimulation treatment based on the acquired DAS measurements;

determine whether to adjust a spacing of perforation clusters used at the treatment wellbore in the stimulation treatment, based on the cumulative strain trace for the current stage and a number of perforation clusters included within the current stage, wherein determining whether to adjust the spacing of the perforation clusters includes:

comparing a ratio of a number of the identified local maxima and the number of perforation clusters included within the current stage to a minimum perforation cluster ratio value; and determining based on the comparison of the ratio and the minimum perforation cluster ratio value, to adjust or maintain the spacing of the perforation clusters;

determine whether to adjust a stage length used at the treatment wellbore in the stimulation treatment, based on a comparison between the cumulative strain trace for the current stage and a previously calculated cumulative strain trace for a previous stage of the stimulation treatment along the treatment wellbore;

responsive to determining to adjust the spacing of the perforation clusters or to adjust the stage length, adjust, based at least in part on the comparison of the ratio and the minimum perforation cluster ratio value, at least one treatment parameter for a subsequent stage of the stimulation treatment along the treatment wellbore; and perform the subsequent stage based on the adjusted at least one treatment parameter.

11. The system of claim 10, wherein the plurality of functions further includes functions to:

responsive to determining to adjust the spacing of the perforation clusters or to adjust the stage length, output a notification for display at a user device.

12. The system of claim 11, wherein the plurality of functions further includes functions to:

adjust the at least one treatment parameter for the subsequent stage of the stimulation treatment along the treatment wellbore further based on receiving, from the user device, a confirmation to adjust the at least one treatment parameter.

13. A computer-readable storage medium comprising computer-readable instructions stored therein, which, when executed by a computer, cause the computer to perform a plurality of functions, including functions to:

acquire distributed acoustic sensing (DAS) measurements at an observation wellbore during a current stage of a stimulation treatment along a treatment wellbore within a reservoir formation;

calculate a cumulative strain trace for the current stage of the stimulation treatment based on the acquired DAS measurements;

determine whether to adjust a spacing of perforation clusters used at the treatment wellbore in the stimulation treatment, based on the cumulative strain trace for the current stage and a number of perforation clusters included within the current stage, wherein determining whether to adjust the spacing of the perforation clusters comprises:

comparing a ratio of a number of identified local maxima and the number of perforation clusters included within the current stage to a minimum perforation cluster value; and determining, based on the comparison of the ratio and the minimum perforation cluster ratio value, to adjust or maintain the spacing of the perforation clusters;

determine whether to adjust a stage length used at the treatment wellbore in the stimulation treatment, based on a comparison between the cumulative strain trace for the current stage and a previously calculated cumulative strain trace for a previous stage of the stimulation treatment along the treatment wellbore;

responsive to determining to adjust the spacing of the perforation clusters or to adjust the stage length, adjust, based at least in part on the comparison of the ratio and the minimum perforation cluster ratio value, at least one treatment parameter for a subsequent stage of the stimulation treatment along the treatment wellbore; and perform the subsequent stage based on the adjusted at least one treatment parameter.

14. The computer-readable storage medium of claim 13, wherein the determining whether to adjust the stage length includes:

identifying local maxima within the cumulative strain trace for the current stage and the cumulative strain trace for the previous stage; and determining, based on a comparison of the identified local maxima, whether inter-stage stimulated reservoir volume overlapping or inter-stage reservoir volume bypassing occurred between the current stage and the previous stage during the stimulation treatment along the treatment wellbore.

15. The computer-readable storage medium of claim 13, wherein the plurality of functions, further includes functions to:

acquire the DAS measurements via a fiber-optic sensor positioned within the observation wellbore.

* * * * *